US011587488B2

(12) United States Patent
Pyun et al.

(10) Patent No.: US 11,587,488 B2
(45) Date of Patent: Feb. 21, 2023

(54) DISPLAY APPARATUS AND METHOD OF DRIVING THE SAME

(71) Applicant: Samsung Display Co., Ltd., Yongin-Si (KR)

(72) Inventors: Kihyun Pyun, Gwangmyeong-si (KR); Wonjin Seo, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/582,458

(22) Filed: Jan. 24, 2022

(65) Prior Publication Data

US 2022/0406235 A1 Dec. 22, 2022

(30) Foreign Application Priority Data

Jun. 16, 2021 (KR) ..... 10-2021-0078311

(51) Int. Cl.
*G09G 3/20* (2006.01)

(52) U.S. Cl.
CPC ..... *G09G 3/20* (2013.01); *G09G 2320/041* (2013.01); *G09G 2320/0686* (2013.01)

(58) Field of Classification Search
CPC ..... G09G 3/20; G09G 2320/041; G09G 2320/0686
See application file for complete search history.

(56) References Cited

U.S. PATENT DOCUMENTS

2017/0236490 A1* 8/2017 Cheon ..... G09G 5/10 345/691

FOREIGN PATENT DOCUMENTS

| | | | |
|---|---|---|---|
| KR | 101298921 | B1 | 8/2013 |
| KR | 101314088 | B1 | 10/2013 |
| KR | 101954934 | B1 | 3/2019 |

* cited by examiner

*Primary Examiner* — Gerald Johnson
(74) *Attorney, Agent, or Firm* — Cantor Colburn LLP

(57) ABSTRACT

A display apparatus include a display panel and a display panel driver. The display panel includes a panel block. The display panel driver senses a driving current to generate a sensing current, generates a temperature weight of the panel block based on the sensing current and location information of a circuit component, generates a load value of the panel block based on input image data, and generates a predicted temperature of the panel block based on the temperature weight of the panel block and the load value of the panel block.

19 Claims, 23 Drawing Sheets

FIG. 5A

100

PB

| | | | | | | | | | | |
|---|---|---|---|---|---|---|---|---|---|---|
| 11 | 12 | 13 | 14 | 15 | 16 | 17 | 18 | 19 | 1A | 1B | 1C |
| 21 | 22 | 23 | 24 | 25 | 26 | 27 | 28 | 29 | 2A | 2B | 2C |
| 31 | 32 | 33 | 34 | 35 | 36 | 37 | 38 | 39 | 3A | 3B | 3C |
| 41 | 42 | 43 | 44 | 45 | 46 | 47 | 48 | 49 | 4A | 4B | 4C |
| 51 | 52 | 53 | 54 | 55 | 56 | 57 | 58 | 59 | 5A | 5B | 5C |
| 61 | 62 | 63 | 64 | 65 | 66 | 67 | 68 | 69 | 6A | 6B | 6C |
| 71 | 72 | 73 | 74 | 75 | 76 | 77 | 78 | 79 | 7A | 7B | 7C |
| 81 | 82 | 83 | 84 | 85 | 86 | 87 | 88 | 89 | 8A | 8B | 8C |

FIG. 7

| | |
|---|---|
| FIRST PANEL BLOCK(PB1) | 71, 72, 73, 74, 75, 76, 77, 78, 79, 7A, 7B, 7C, 81, 82, 83, 84, 85, 86, 87, 88, 89, 8A, 8B, 8C |
| SECOND PANEL BLOCK(PB2) | 73, 74, 79, 7A |
| THIRD PANEL BLOCK(PB3) | 55, 56, 57, 58, 65, 66, 67, 68, 75, 76, 77, 78 |
| FOURTH PANEL BLOCK(PB4) | 35, 36, 37, 38, 45, 46, 47, 48, 55, 56, 57, 58 |

FIG. 8

| | |
|---|---|
| PANEL BLOCK APPLIED FIRST TEMPERATURE WEIGHT | 71, 72, 73, 74, 75, 76, 77, 78, 79, 7A, 7B, 7C, 81, 82, 83, 84, 85, 86, 87, 88, 89, 8A, 8B, 8C |
| PANEL BLOCK APPLIED SECOND TEMPERATURE WEIGHT | 73, 74, 79, 7A |
| PANEL BLOCK APPLIED THIRD TEMPERATURE WEIGHT | 55, 56, 57, 58, 65, 66, 67, 68, 75, 76, 77, 78 |
| PANEL BLOCK APPLIED FOURTH TEMPERATURE WEIGHT | 35, 36, 37, 38, 45, 46, 47, 48, 55, 56, 57, 58 |

FIG. 9

| | |
|---|---|
| PANEL BLOCK APPLIED FIRST TEMPERATURE WEIGHT | 71, 72, 7A, 7B, 7C, 81, 82, 83, 84, 85, 86, 87, 88, 89, 8A, 8B, 8C |
| PANEL BLOCK APPLIED SECOND TEMPERATURE WEIGHT | 73, 74, 79, 7A |
| PANEL BLOCK APPLIED THIRD TEMPERATURE WEIGHT | 65, 66, 67, 68, 75, 76, 77, 78 |
| PANEL BLOCK APPLIED FOURTH TEMPERATURE WEIGHT | 35, 36, 37, 38, 45, 46, 47, 48, 55, 56, 57, 58 |

FIG. 13

| | |
|---|---|
| FIRST ADJACENT PANEL BLOCK(PB1') | 61, 62, 63, 64, 65, 66, 67, 68, 69, 6A, 6B, 6C |
| SECOND ADJACENT PANEL BLOCK(PB2') | 62, 63, 64, 65, 68, 69, 6A, 6B, 72, 75, 7B, 82, 83, 84, 85, 88, 89, 8A, 8B |
| THIRD ADJACENT PANEL BLOCK(PB3') | 44, 45, 46, 47, 48, 49, 54, 59, 64, 69, 74, 79, 84, 85, 86, 87, 88, 89 |
| FOURTH ADJACENT PANEL BLOCK(PB4') | 24, 25, 26, 27, 28, 29, 34, 39, 44, 49, 54, 59, 64, 65, 66, 67, 68, 69 |

$0 < SF3 \leq 1$

FIG. 14

| | |
|---|---|
| PANEL BLOCK APPLIED FIRST TEMPERATURE WEIGHT AND THIRD SCALE FACTOR | 61, 62, 63, 64, 65, 66, 67, 68, 69, 6A, 6B, 6C |
| PANEL BLOCK APPLIED SECOND TEMPERATURE WEIGHT AND THIRD SCALE FACTOR | 62, 63, 64, 65, 68, 69, 6A, 6B, 72, 75, 7B, 82, 83, 84, 85, 88, 89, 8A, 8B |
| PANEL BLOCK APPLIED THIRD TEMPERATURE WEIGHT AND THIRD SCALE FACTOR | 44, 45, 46, 47, 48, 49, 54, 59, 64, 69, 74, 79, 84, 85, 86, 87, 88, 89 |
| PANEL BLOCK APPLIED FOURTH TEMPERATURE WEIGHT AND THIRD SCALE FACTOR | 24, 25, 26, 27, 28, 29, 34, 39, 44, 49, 54, 59, 64, 65, 66, 67, 68, 69 |

$0 < SF3 \leq 1$

FIG. 21

| | |
|---|---|
| FIRST PANEL BLOCK | 71, 72, 73, 74, 75, 76, 77, 78, 79, 7A, 7B, 7C, 81, 82, 83, 84, 85, 86, 87, 88, 89, 8A, 8B, 8C |
| SECOND PANEL BLOCK | 73, 74, 79, 7A |
| THIRD PANEL BLOCK | 52, 53, 54, 62, 63, 64, 65, 66, 67, 68, 75, 76, 77, 78 |
| FOURTH PANEL BLOCK | 32, 33, 34, 35, 42, 43, 44, 45, 52, 53, 54, 55 |

DISPLAY APPARATUS AND METHOD OF DRIVING THE SAME

This application claims priority to Korean Patent Application No. 10-2021-0078311, filed on Jun. 16, 2021, and all the benefits accruing therefrom under 35 U.S.C. § 119, the content of which in its entirety is herein incorporated by reference.

BACKGROUND

1. Field

Embodiments of the invention relate to a display apparatus. More particularly, embodiments of the invention relate to a display apparatus in which a temperature of a display panel is predicted to adjust luminance of an image, and a method of driving the display apparatus.

2. Description of the Related Art

Generally, a display apparatus may include a display panel and a display panel driver. The display panel typically includes gate lines, data lines, and pixels electrically connected to the gate lines and the data lines. The display panel driver may include a gate driver providing a gate signal to the pixels through the gate lines, a data driver for providing a data voltage to the pixels through the data lines, and a driving controller for controlling the gate driver and the data driver.

Luminance of an image displayed by the display apparatus may be affected by a temperature of the display panel. The temperature of the display panel may not be uniform in all parts of the display panel. Accordingly, the luminance may be different for each locations of the display panel.

SUMMARY

Embodiments of the invention provide a display apparatus in which a temperature weight is applied depending on a location of a circuit component to accurately determine a predicted temperature of a panel block.

Embodiments of the invention also provide a method of driving the display apparatus.

In embodiments of a display apparatus according to the invention, the display apparatus includes a display panel including a panel block, and a display panel driver which senses a driving current to generate a sensing current, generates a temperature weight of the panel block based on the sensing current and location information of a circuit component, generates a load value of the panel block based on input image data, and generates a predicted temperature of the panel block based on the temperature weight of the panel block and the load value of the panel block.

In an embodiment, the display apparatus may further includes a temperature sensor which detects an ambient temperature of the display panel. In such an embodiment, the display panel driver may generate the predicted temperature of the panel block based on the ambient temperature, the temperature weight of the panel block, and the load value of the panel block.

In an embodiment, the display panel driver may include a weight lookup table which stores the temperature weight corresponding to the sensing current. In such an embodiment, the temperature weight corresponding to the sensing current may be determined based on a temperature of the circuit component depending on the sensing current and a temperature of the display panel at a location overlapping the circuit component depending on the temperature of the circuit component.

In an embodiment, the display panel driver may include a plurality of printed circuit boards electrically connected to the display panel, a U-film connecting the printed circuit boards to each other, a flexible cable connected to the printed circuit board, and a driving board connected to the flexible cable, where the driving board may generate a signal for driving the display panel. In such an embodiment, the location information of the circuit component may include location information of the printed circuit boards, the U-film, the flexible cable, and the driving board.

In an embodiment, the temperature weight may include a first temperature weight, a second temperature weight, a third temperature weight, and a fourth temperature weight. In such an embodiment, the display panel driver may include a first lookup table which stores the first temperature weight corresponding to the sensing current, a second lookup table which stores the second temperature weight corresponding to the sensing current, a third lookup table which stores the third temperature weight corresponding to the sensing current, and a fourth lookup table which stores the fourth temperature weight corresponding to the sensing current.

In an embodiment, The first temperature weight corresponding to the sensing current may be determined based on a temperature of the printed circuit board depending on the sensing current and a temperature of the display panel at a location overlapping the printed circuit board depending on the temperature of the printed circuit board. In such an embodiment, the second temperature weight corresponding to the sensing current may be determined based on a temperature of the U-film depending on the sensing current and a temperature of the display panel at a location overlapping the U-film depending on the temperature of the U-film. In such an embodiment, the third temperature weight corresponding to the sensing current may be determined based on a temperature of the flexible cable depending on the sensing current and a temperature of the display panel at a location overlapping the flexible cable depending on the temperature of the flexible cable. In such an embodiment, the fourth temperature weight corresponding to the sensing current may be determined based on the temperature of the driving board depending on the sensing current and a temperature of the display panel at a location overlapping the driving board depending on the temperature of the driving board.

In an embodiment, the display panel driver may apply the first temperature weight to the panel block in a case where a first overlap area thereof overlapping the printed circuit board is larger than a second overlap area thereof overlapping the U-film, a third overlap area thereof overlapping the flexible cable, and a fourth overlap area thereof overlapping the driving board. In such an embodiment, the display panel driver may apply the second temperature weight to the panel block in a case where the second overlap area is larger than the first overlap area, the third overlap area, and the fourth overlap area. In such an embodiment, the display panel driver may apply the third temperature weight to the panel block in a case where the third overlap area is larger than the first overlap area, the second overlap area, and the fourth overlap area. In such an embodiment, the display panel driver may apply the fourth temperature weight to the panel block in a case where the fourth overlap area is larger than the first overlap area, the second overlap area, and the third overlap area.

In an embodiment, the display panel driver may apply the first temperature weight to a first panel block including a first overlap area overlapping the printed circuit boards. In such an embodiment, the display panel driver may apply the second temperature weight to a second panel block including a second overlap area overlapping the U-film. In such an embodiment, the display panel driver may apply the third temperature weight to a third panel block including a third overlap area overlapping the flexible cable. In such an embodiment, the display panel driver may apply the fourth temperature weight to a fourth panel block including a fourth overlap area overlapping the driving board.

In an embodiment, the display panel driver may apply the first temperature weight and a first scale factor to the first panel block. In such an embodiment, the first scale factor may decrease as a distance between the first panel block and a connecting portion where the printed circuit board and the flexible cable are connected increases.

In an embodiment, the display panel driver may apply the fourth temperature weight and a second scale factor to the fourth panel block. In such an embodiment, the second scale factor may be determined based on an arrangement of an internal circuit of the driving board.

In an embodiment, the display panel driver may apply the first temperature weight and a third scale factor to a first adjacent panel block adjacent to the first panel block. In such an embodiment, the display panel driver may apply the second temperature weight and the third scale factor to a second adjacent panel block adjacent to the second panel block. In such an embodiment, the display panel driver may apply the third temperature weight and the third scale factor to a third adjacent panel block adjacent to the third panel block. In such an embodiment, the display panel driver may apply the fourth temperature weight and the third scale factor to a fourth adjacent panel block adjacent to the fourth panel block.

In an embodiment, the third scale factor may be greater than 0 and less than 1.

In an embodiment, the display panel driver may apply the first temperature weight to the first panel block when the sensing current is greater than a first reference current. In such an embodiment, the display panel driver may apply the second temperature weight to the second panel block when the sensing current is greater than a second reference current. In such an embodiment, the display panel driver may apply the third temperature weight to the third panel block when the sensing current is greater than a third reference current. In such an embodiment, the display panel driver may apply the fourth temperature weight to the fourth panel block when the sensing current is greater than a fourth reference current.

In embodiments of a method of driving a display apparatus according to the invention, the method includes sensing a driving current to generate a sensing current, determining a temperature weight of a panel block of a display panel of the display apparatus based on the sensing current and a location of a circuit component, generating a predicted temperature of the panel block based on the temperature weight of the panel block and a load value of the panel block, and generating compensated image data based on the predicted temperature of the panel block and input image data.

In an embodiment, the generating the predicted temperature may include calculating the load value of the panel block based on the input image data, generating an initial predicted temperature of the panel block based on the load value of the panel block, and adding the initial predicted temperature of the panel block and the temperature weight of the panel block to generate the predicted temperature of the panel block.

In an embodiment, the method further includes detecting an ambient temperature of the display panel. T In such an embodiment, the he predicted temperature of the panel block may be generated based on the temperature weight of the panel block, the ambient temperature, and the load value of the panel block.

In an embodiment, the temperature weight of the panel block may be determined based on a weight lookup table. In such an embodiment, the weight lookup table may store the temperature weight corresponding to the sensing current. In such an embodiment, the temperature weight corresponding to the sensing current may be determined based on a temperature measurement value of the display panel depending on a test driving current.

In an embodiment, the temperature weight of the panel block may be determined based on a weight lookup table. In such an embodiment, the weight lookup table may store the temperature weight corresponding to the sensing current. In such an embodiment, the temperature weight corresponding to the sensing current may be determined based on a temperature measurement value of the circuit component depending on a test driving current and a temperature measurement value of the display panel depending on the temperature measurement value of the circuit component.

In an embodiment, the temperature weight may include a first temperature weight, a second temperature weight, a third temperature weight, and a fourth temperature weight. In such an embodiment, the first temperature weight may be applied to a first panel block including a first overlap area overlapping a printed circuit board of the circuit component. In such an embodiment, the second temperature weight may be applied to a second panel block including a second overlap area overlapping a U-film of the circuit component. In such an embodiment, the third temperature weight may be applied to a third panel block including a third overlap area overlapping a flexible cable. of the circuit component In such an embodiment, the fourth temperature weight may be applied to a fourth panel block including a fourth overlap area overlapping a driving board of the circuit component.

According to embodiments of the display apparatus and the method of driving the display apparatus, a display panel driver of the display apparatus may generate a temperature weight of a panel block of a display panel of the display apparatus based on a location of a circuit component, so that the predicted temperature of the panel block may be accurately calculated.

According to embodiments of the display apparatus and the method of driving the display apparatus, a display panel driver of the display apparatus may generate a temperature weight for each of a printed circuit board, a U-film, a flexible cable, and a driving board, so that a temperature change of the display panel due to each of circuit components may be compensated and the image quality may be enhanced.

BRIEF DESCRIPTION OF THE DRAWINGS

The above and other features of the invention will become more apparent by describing in detailed embodiments thereof with reference to the accompanying drawings, in which:

FIG. 5A is a diagram illustrating a display panel of the display apparatus of FIG. 4;

FIGS. 7 and 8 are tables illustrating panel blocks of the display apparatus of FIG. 4;

FIG. 9 is a table illustrating panel blocks of a display apparatus according to an embodiment;

FIG. 13 is a table illustrating adjacent panel blocks of the display apparatus of FIG. 4;

FIG. 14 is a table illustrating a panel block of the display apparatus of FIG. 4 to which a temperature weight and a third scale factor are applied;

FIG. 21 is a table illustrating panel blocks of the display apparatus of FIG. 19.

DETAILED DESCRIPTION

Figure 1:
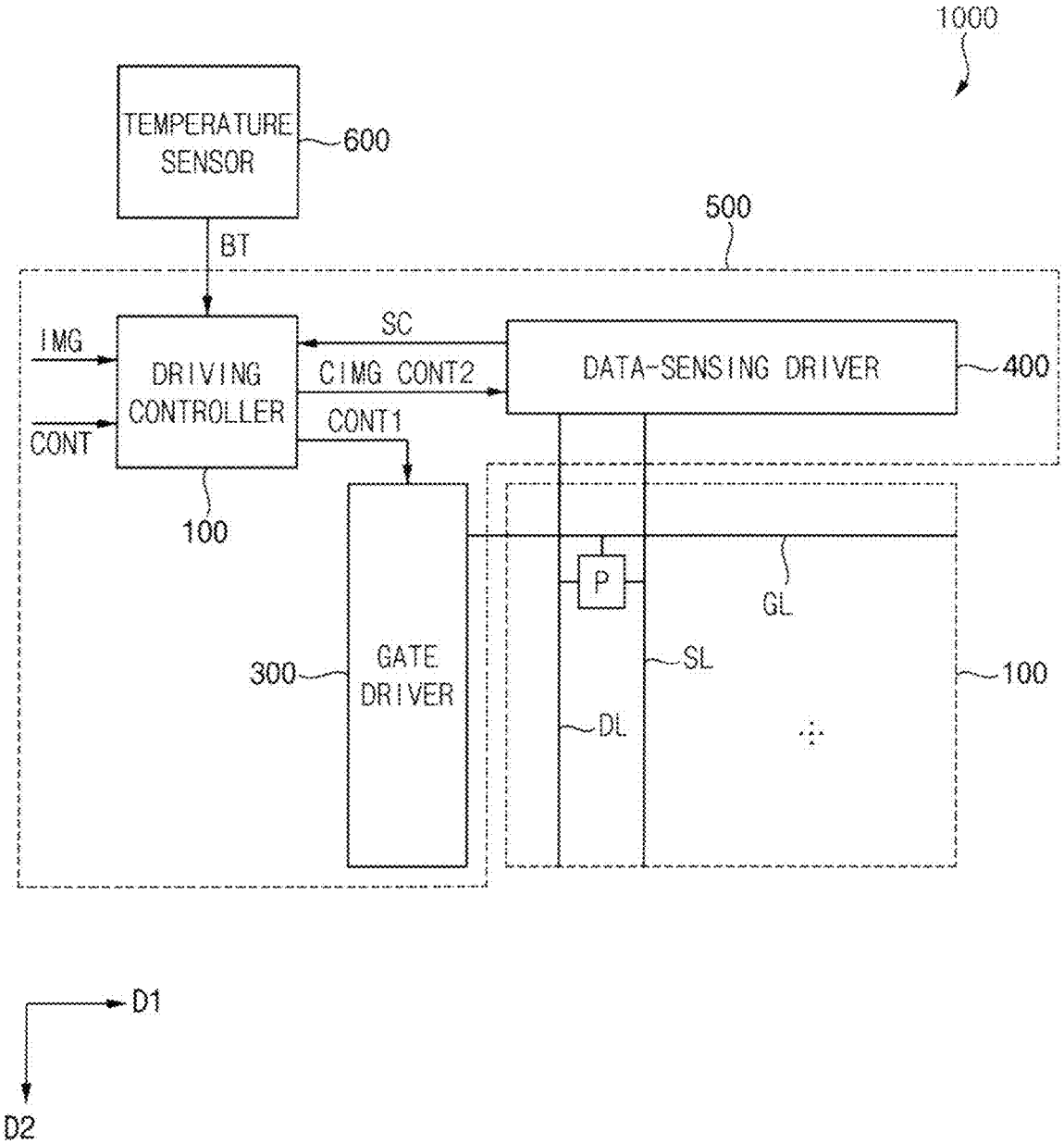
FIG. 1 is a block diagram illustrating a display apparatus according to embodiments of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a block diagram illustrating a display apparatus 1000 according to embodiments of the invention.

Referring to FIG. 1, an embodiment of the display apparatus 1000 may include a display panel 100 and a display panel driver 500. According to an embodiment, the display apparatus 1000 may further include a temperature sensor 600 that detects an ambient temperature BT of the display panel 100. The ambient temperature BT may be the same as a temperature of the display panel 100 when the input image data IMG is black image data and the display panel 100 displays a black image. The display panel driver 500 may include a driving controller 200, a gate driver 300, and a data-sensing driver 400. According to an embodiment, the driving controller 200 and the data-sensing driver 400 may be integrated into a single chip. According to an embodiment, the driving controller 200, the gate driver 300, and the data-sensing driver 400 may be integrated into a single chip.

The display panel 100 may include a plurality of gate lines GL, a plurality of data lines DL, and a plurality of pixels P electrically connected to the data lines DL and the gate lines GL. According to an embodiment, the gate lines GL may extend in a first direction D1 and the data lines DL may extend in a second direction D2 crossing the first direction D1. In an embodiment, the display panel 100 may further include a plurality of sensing lines SL connected to the pixels P. The sensing lines SL may extend in the second direction D2. In an embodiment, the display panel 100 may include a panel block PB (shown in FIG. 5A). The panel block PB may include the plurality of pixels P.

In an embodiment, the display panel driver 500 may include a sensing circuit that receives a sensing signal from the pixels P of the display panel 100 through the sensing lines SL. The sensing circuit may be disposed in the data-sensing driver 400. Alternatively, the sensing circuit may be formed independently from the data-sensing driver 400. The invention is not limited to a specific location of the sensing circuit.

The driving controller 200 may receive input image data IMG and an input control signal CONT from an external apparatus (e.g. a graphic processing unit; GPU). In an embodiment, for example, the input image data IMG may include red image data, green image data and blue image data. According to an embodiment, the input image data IMG may further include white image data. In an alternative embodiment, for example, the input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, and a compensated image data CIMG based on the input image data IMG, a sensing current SC, and the input control signal CONT. According to an embodiment, the driving controller 200 may generate the first control signal CONT1, the second control signal CONT2, and the compensated image data CIMG based on the input image data IMG, the sensing current SC, the ambient temperature BT, and the input control signal CONT.

The driving controller 200 may generate the first control signal CONT1 for controlling operation of the gate driver 300 based on the input control signal CONT and output the first control signal CONT1 to the gate driver 300. The first control signal CONT1 may include a vertical start signal and a gate clock signal.

The driving controller 200 may generate the second control signal CONT2 for controlling operation of the data-sensing driver 400 based on the input control signal CONT and output the second control signal CONT2 to the data-sensing driver 400. According to an embodiment, the second control signal CONT2 may include a horizontal start signal and a load signal.

The driving controller 200 may generate the compensated image data CIMG based on the input image data IMG. The driving controller may transmit the compensated image data CIMG to the data-sensing driver 400.

The gate driver 300 may generate gate signals in response to the first control signal CONT1 input from the driving controller 200. The gate driver 300 may output the gate signals to the gate lines GL. In an embodiment, for example, the gate driver 300 may sequentially output the gate signals to the gate lines GL.

The data-sensing driver 400 may receive the second control signal CONT2 and the compensated image data CIMG from the driving controller 200. The data-sensing driver 400 may convert the compensated image data CIMG into a data voltage having an analog type. The data-sensing driver 400 may output the data voltage to the data lines DL.

The data-sensing driver 400 may sense a driving current from the sensing line SL.

The data-sensing driver 400 may sense the driving current to generate the sensing current SC. The data-sensing driver 400 may provide the sensing current SC to the driving controller 200.

Figure 2:
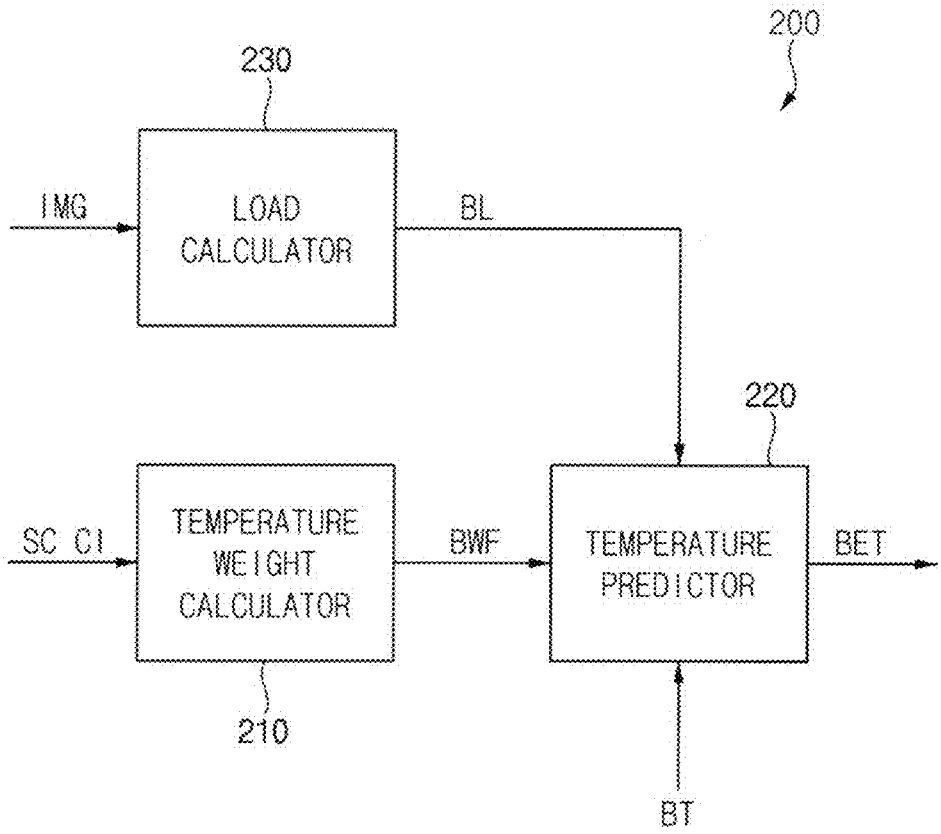
FIG. 2 is a block diagram illustrating a driving controller of the display apparatus of FIG. 1.

FIG. 2 is a block diagram illustrating the driving controller 200 of the display apparatus 1000 of FIG. 1.

Referring to FIGS. 1 and 2, an embodiment of the display panel 100 may include the panel block PB. The display panel driver 500 may sense the driving current from the sensing line SL and generate the sensing current SC based on the driving current from the sensing line SL. The display panel driver 500 may generate a temperature weight BWF of the panel block based on the sensing current SC and location information CI of a circuit components (e.g. a printed circuit board, a U-film, a flexible cable, and a driving board).

The display panel driver 500 may generate a load value BL of the panel block based on the input image data IMG. The display panel driver 500 may generate a predicted temperature BET of the panel block based on the temperature weight BWF of the panel block and the load value BL of the panel block. According to an embodiment, the display panel driver 500 may generate the predicted temperature BET of the panel block based on the ambient temperature BT, the temperature weight BWF of the panel block, and the load value BL of the panel block.

In an embodiment, for example, the driving controller 200 may include a temperature weight calculator 210, a temperature predictor 220, and a load calculator 230.

The temperature weight calculator 210 may generate the temperature weight BWF of the panel block based on the sensing current SC and the location information CI of the circuit component. The temperature weight calculator 210 may determine the panel block PB, to which the temperature weight WF is applied, based on the location information CI of the circuit component. The temperature weight calculator 210 may determine the temperature weight WF based on the sensing current SC.

The temperature predictor 220 may generate the predicted temperature BET of the panel block based on the temperature weight BWF of the panel block and the load value BL of the panel block. According to an embodiment, the temperature predictor 220 may generate the predicted temperature BET of the panel block based on the temperature weight BWF of the panel block, the ambient temperature BT, and the load value BL of the panel block. The temperature predictor 220 may generate an initial predicted temperature of the panel block based on the load value BL of the panel block. In some embodiments, the temperature predictor 220 may generate the initial predicted temperature of the panel block based on the load value BL of the panel block and the ambient temperature BT. The temperature predictor 220 may add the initial predicted temperature of the panel block and the temperature weight BWF of the panel block to generate the predicted temperature BET of the panel block.

The load calculator 230 may calculate the load value BL of the panel block based on the input image data IMG.

Figure 3:
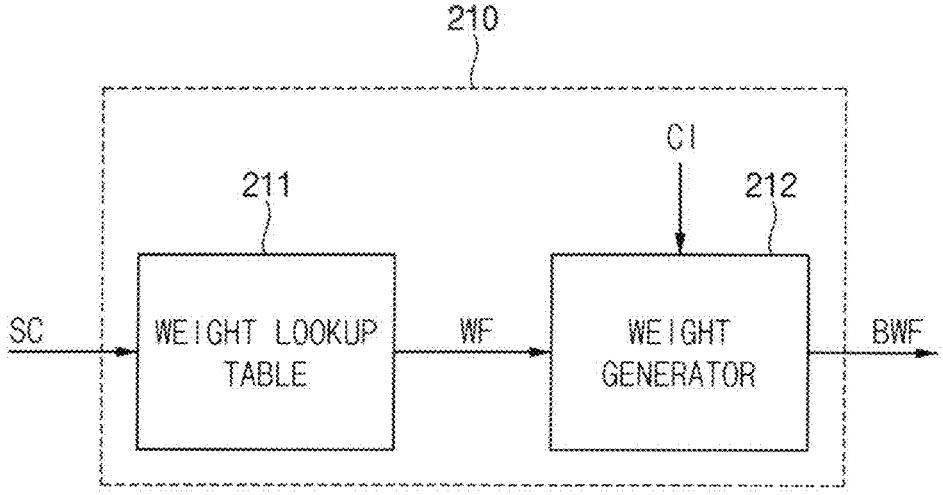
FIG. 3 is a block diagram illustrating a temperature weight calculator of the driving controller of FIG. 1.

FIG. 3 is a block diagram illustrating the temperature weight calculator 210 of the driving controller 200 of FIG. 1.

Referring to FIG. 3, the display panel driver 500 may include a weight lookup table 211 that stores the temperature weight WF corresponding to the sensing current SC. According to an embodiment, the temperature weight WF corresponding to the sensing current SC may be determined based on a temperature of the circuit component depending on (or sensed based on) the sensing current SC and a temperature of the display panel 100 at a location overlapping the circuit component depending on the temperature of the circuit component.

The temperature weight calculator 210 may include the weight lookup table 211 and a weight generator 212. The weight lookup table 211 may store the temperature weight WF depending on the sensing current SC. In an embodiment, for example, a temperature increased due to a temperature rise of the circuit component depending on the sensing current SC may be calculated based on the temperature of the circuit component depending on the sensing current SC and the temperature of the display panel 100 at the location overlapping the circuit component depending on the temperature of the circuit component.

In an embodiment, for example, the temperature of the circuit component depending on the sensing current SC may be calculated based on a temperature measurement value of the circuit component depending on a test driving current in a pre-driving process (e.g. a product inspection process, a product manufacturing process, etc.). The test driving current may mean a driving current flowing through the display panel 100 in the pre-driving process. In an embodiment, for example, the temperature of the display panel 100 at the location overlapping the circuit component depending on the temperature of the circuit component may be calculated based on a temperature measurement value of the display panel 100 at the location overlapping the circuit component depending on the temperature of the circuit component in the pre-driving process. In an embodiment, for example, the temperature of the display panel 100 at the location overlapping the circuit component depending on the temperature of the circuit component may be calculated by comparing the temperature measurement value of the display panel 100 at the location overlapping the circuit component and a temperature measurement value of the display panel 100 at a location not overlapping the circuit component in the pre-driving process.

According to an embodiment, the temperature weight WF depending on the sensing current SC may be determined based on the temperature of the display panel 100 at the location overlapping the circuit component depending on the sensing current SC. In an embodiment, for example, the temperature of the display panel 100 at the location overlapping the circuit component depending on the sensing current SC may be calculated based on a temperature measurement value of the display panel 100 depending on the test driving current in the pre-driving process.

Figure 4:
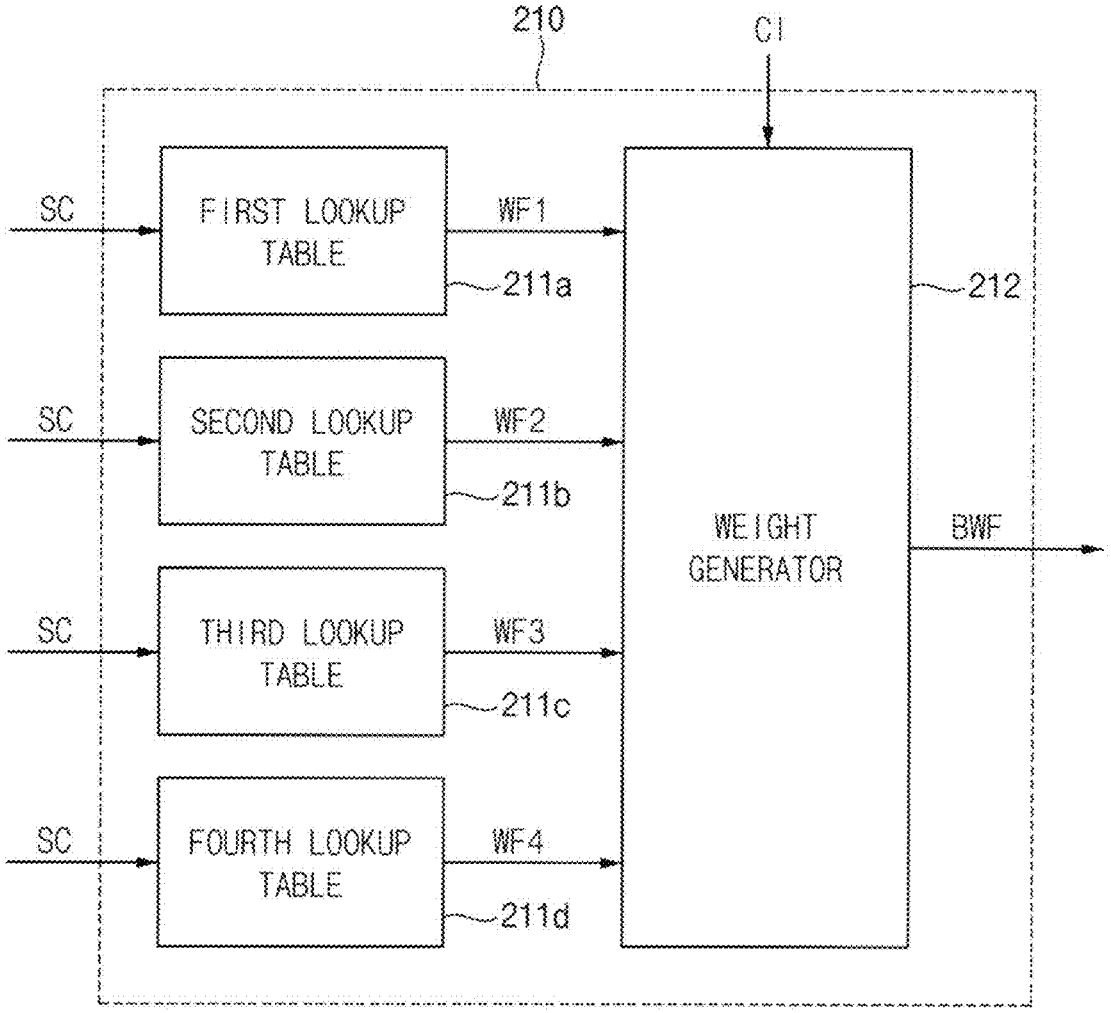
FIG. 4 is a block diagram illustrating a temperature weight calculator of a display apparatus according to an embodiment of the invention.
Figure 5B:
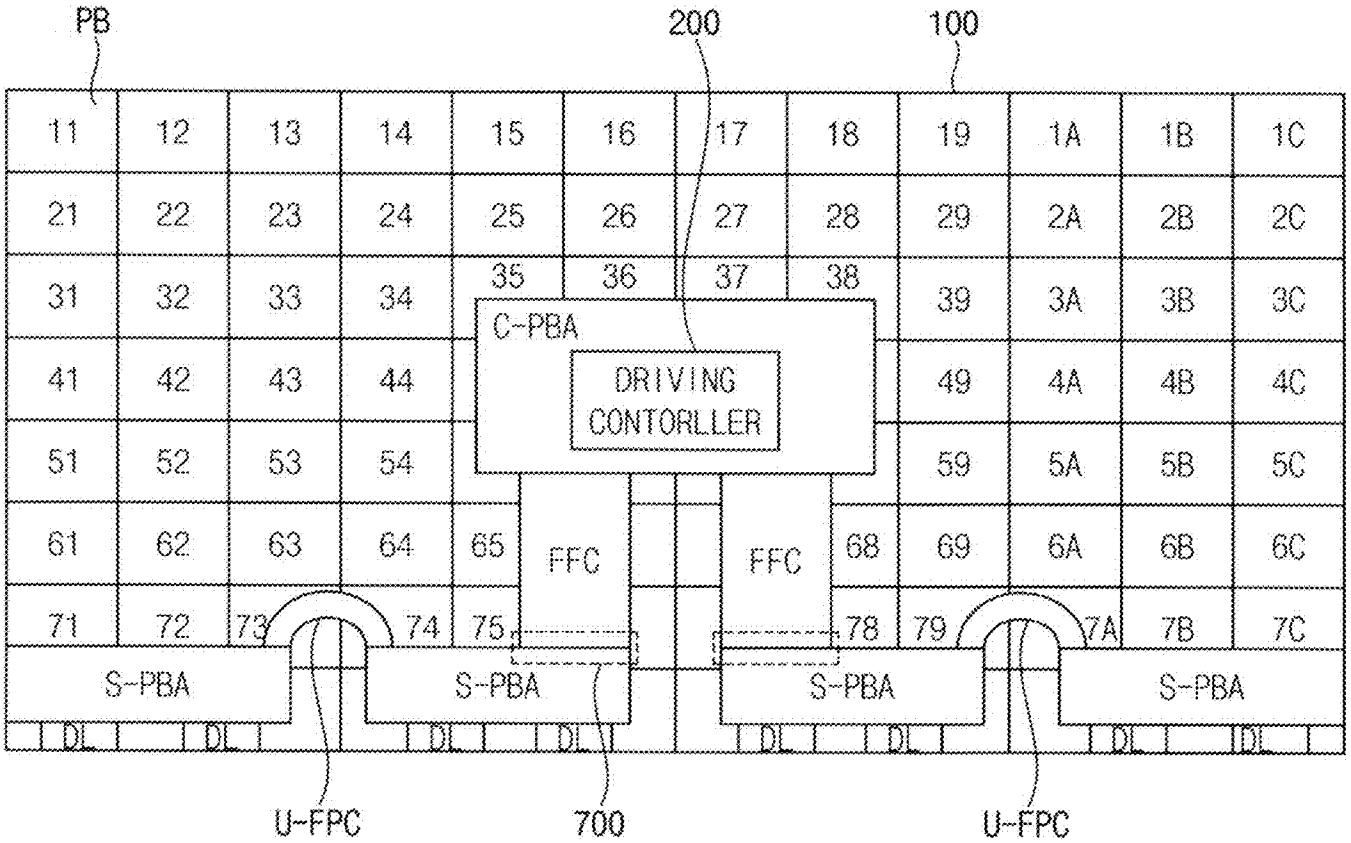
FIG. 5B is a block diagram illustrating a part of the display apparatus of FIG. 4.
Figure 6:
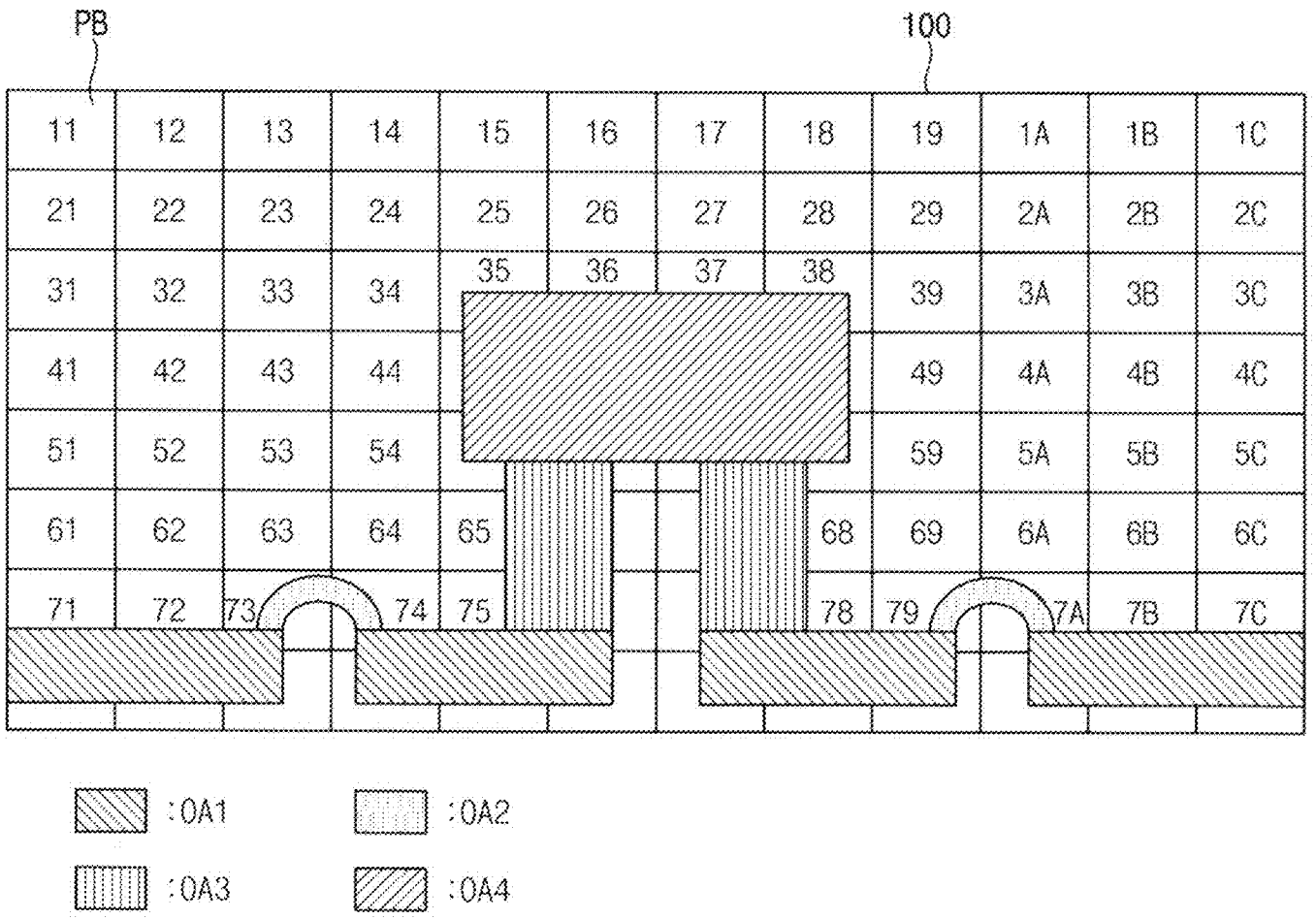
FIG. 6 is a diagram illustrating a display panel of the display apparatus of FIG. 4.

FIG. 4 is a block diagram illustrating a temperature weight calculator 210 of a display apparatus according to an embodiment of the invention, FIG. 5A is a diagram illustrating a display panel 100 of the display apparatus of FIG. 4, FIG. 5B is a block diagram illustrating a part of the display apparatus of FIG. 4, FIG. 6 is a diagram illustrating a display panel 100 of the display apparatus of FIG. 4, and FIGS. 7 and 8 are tables illustrating panel blocks PB of the display apparatus of FIG. 4.

The display apparatus of FIG. 4 to 8 is substantially the same as the display apparatus 1000 of FIGS. 1 to 3 except for a structure of the temperature weight calculator 210.

Thus, the same reference numerals are used to refer to the same or similar element, and any repetitive detailed description thereof will be omitted.

Referring to FIGS. 1, 2, 4, 5A, and 5B, an embodiment of the display panel 100 may include the panel block PB, e.g., blocks 1 to 89 and 1A to 8C shown in FIG. 5A. The panel block PB may include the pixels P. The display panel driver 500 may include a plurality of printed circuit boards S-PBA electrically connected to the display panel 100. The display panel driver 500 may further include a U-film U-FPC connecting the printed circuit boards S-PBA to each other. The display panel driver 500 may further include a flexible cable FFC connected to the printed circuit board S-PBA. The display panel driver 500 may further include a driving board C-PBA which his connected to the flexible cable FFC and generates a signal for driving the display panel 100. The location information CI of the circuit component may include location information of the printed circuit board S-PBA, the U-film U-FPC, the flexible cable FFC, and the driving board C-PBA. The driving board C-PBA may include the driving controller 200.

The temperature weight WF may include a first temperature weight WF1, a second temperature weight WF2, a third temperature weight WF3, and a fourth temperature weight WF4. The display panel driver 500 may include a first lookup table 211*a* that stores the first temperature weight WF1 corresponding to the sensing current SC, a second lookup table 211*b* that stores the second temperature weight WF2 corresponding to the sensing current SC, a third lookup table 211*c* that stores the third temperature weight WF3 corresponding to the sensing current SC, and a fourth lookup table 211*d* that stores the fourth temperature weight WF4 corresponding to the sensing current SC.

The first temperature weight WF1 corresponding to the sensing current SC may be determined based on a temperature of the printed circuit board S-PBA depending on the sensing current SC and a temperature of the display panel 100 at a location overlapping the printed circuit board S-PBA depending on the temperature of the printed circuit board S-PBA. The second temperature weight WF2 corresponding to the sensing current SC may be determined based on a temperature of the U-film U-FPC depending on the sensing current SC and a temperature of the display panel 100 at a location overlapping the U-film U-FPC depending on the temperature of the U-film U-FPC. The third temperature weight WF3 corresponding to the sensing current SC may be determined based on a temperature of the flexible cable FFC depending on the sensing current SC and a temperature of the display panel 100 at a location overlapping the flexible cable FFC depending on the temperature of the flexible cable FFC. The fourth temperature weight WF4 corresponding to the sensing current SC is determined based on the temperature of the driving board C-PBA depending on the sensing current SC and a temperature of the display panel 100 at a location overlapping the driving board C-PBA depending on the temperature of the driving board C-PBA.

The first lookup table 211*a* may store the first temperature weight WF1 depending on the sensing current SC. In an embodiment, for example, a temperature increased due to a temperature rise of the printed circuit board S-PBA depending on the sensing current SC may be calculated based on the temperature of the printed circuit board S-PBA depending on the sensing current SC and the temperature of the display panel 100 at the location overlapping the printed circuit board S-PBA depending on the temperature of the printed circuit board S-PBA.

In an embodiment, for example, the temperature of the printed circuit board S-PBA depending on the sensing current SC may be calculated based on a temperature measurement value of the printed circuit board S-PBA depending on the test driving current in the pre-driving process. In an embodiment, for example, the temperature of the display panel 100 at the location overlapping the printed circuit board S-PBA depending on the temperature of the printed circuit board S-PBA may be calculated based on a temperature measurement value of the display panel 100 at the location overlapping the printed circuit board S-PBA depending on the temperature of the printed circuit board S-PBA in the pre-driving process. In an embodiment, for example, the temperature of the display panel 100 at the location overlapping the printed circuit board S-PBA depending on the temperature of the printed circuit board S-PBA may be calculated by comparing the temperature measurement value of the display panel 100 at the location overlapping the printed circuit board S-PBA and a temperature measurement value of the display panel 100 at a location not overlapping the printed circuit board S-PBA in the pre-driving process.

According to an embodiment, the first temperature weight WF1 depending on the sensing current SC may be determined based on the temperature of the display panel 100 at the location overlapping the printed circuit board S-PBA depending on the sensing current SC. In an embodiment, for example, the temperature of the display panel 100 at the location overlapping the printed circuit board S-PBA depending on the sensing current SC may be calculated based on a temperature measurement value of the display panel 100 depending on the test driving current in the pre-driving process.

The second lookup table 211*b* may store the second temperature weight WF2 depending on the sensing current SC. In an embodiment, for example, a temperature increased due to a temperature rise of the U-film U-FPC depending on the sensing current SC may be calculated based on the temperature of the U-film U-FPC depending on the sensing current SC and the temperature of the display panel 100 at the location overlapping the U-film U-FPC depending on the temperature of the U-film U-FPC.

In an embodiment, for example, the temperature of the U-film U-FPC depending on the sensing current SC may be calculated based on a temperature measurement value of the U-film U-FPC depending on the test driving current in the pre-driving process. In an embodiment, for example, the temperature of the display panel 100 at the location overlapping the U-film U-FPC depending on the temperature of the U-film U-FPC may be calculated based on a temperature measurement value of the display panel 100 at the location overlapping the U-film U-FPC depending on the temperature of the U-film U-FPC in the pre-driving process. In an embodiment, for example, the temperature of the display panel 100 at the location overlapping the U-film U-FPC depending on the temperature of the U-film U-FPC may be calculated by comparing the temperature measurement value of the display panel 100 at the location overlapping the U-film U-FPC and a temperature measurement value of the display panel 100 at a location not overlapping the U-film U-FPC in the pre-driving process.

According to an embodiment, the second temperature weight WF1 depending on the sensing current SC may be determined based on the temperature of the display panel 100 at the location overlapping the U-film U-FPC depending on the sensing current SC. In an embodiment, for example, the temperature of the display panel 100 at the location overlapping the U-film U-FPC depending on the sensing current SC may be calculated based on a temperature measurement value of the display panel 100 depending on the test driving current in the pre-driving process.

The third lookup table 211*c* may store the third temperature weight WF3 depending on the sensing current SC. In an embodiment, for example, a temperature increased due to a temperature rise of the flexible cable FFC depending on the sensing current SC may be calculated based on the temperature of the flexible cable FFC depending on the sensing current SC and the temperature of the display panel 100 at the location overlapping the flexible cable FFC depending on the temperature of the flexible cable FFC.

In an embodiment, for example, the temperature of the flexible cable FFC depending on the sensing current SC may be calculated based on a temperature measurement value of the flexible cable FFC depending on the test driving current in the pre-driving process. In an embodiment, for example, the temperature of the display panel 100 at the location overlapping the flexible cable FFC depending on the temperature of the flexible cable FFC may be calculated based on a temperature measurement value of the display panel 100 at the location overlapping the flexible cable FFC depending on the temperature of the flexible cable FFC in the pre-driving process. In an embodiment, for example, the temperature of the display panel 100 at the location overlapping the flexible cable FFC depending on the temperature of the flexible cable FFC may be calculated by comparing the temperature measurement value of the display panel 100 at the location overlapping the flexible cable FFC and a temperature measurement value of the display panel 100 at a location not overlapping the flexible cable FFC in the pre-driving process.

According to an embodiment, the third temperature weight WF3 depending on the sensing current SC may be determined based on the temperature of the display panel 100 at the location overlapping the flexible cable FFC depending on the sensing current SC. In an embodiment, for example, the temperature of the display panel 100 at the location overlapping the flexible cable FFC depending on the sensing current SC may be calculated based on a temperature measurement value of the display panel 100 depending on the test driving current in the pre-driving process.

The fourth lookup table 211*d* may store the fourth temperature weight WF4 depending on the sensing current SC. In an embodiment, for example, a temperature increased due to a temperature rise of the driving board C-PBA depending on the sensing current SC may be calculated based on the temperature of the driving board C-PBA depending on the sensing current SC and the temperature of the display panel 100 at the location overlapping the driving board C-PBA depending on the temperature of the driving board C-PBA.

In an embodiment, for example, the temperature of the driving board C-PBA depending on the sensing current SC may be calculated based on a temperature measurement value of the driving board C-PBA depending on the test driving current in the pre-driving process. In an embodiment, for example, the temperature of the display panel 100 at the location overlapping the driving board C-PBA depending on the temperature of the driving board C-PBA may be calculated based on a temperature measurement value of the display panel 100 at the location overlapping the driving board C-PBA depending on the temperature of the driving board C-PBA in the pre-driving process. In an embodiment, for example, the temperature of the display panel 100 at the location overlapping the driving board C-PBA depending on the temperature of the driving board C-PBA may be calculated by comparing the temperature measurement value of the display panel 100 at the location overlapping the driving board C-PBA and a temperature measurement value of the display panel 100 at a location not overlapping the driving board C-PBA in the pre-driving process.

According to an embodiment, the fourth temperature weight WF4 depending on the sensing current SC may be determined based on the temperature of the display panel 100 at the location overlapping the driving board C-PBA depending on the sensing current SC.

In an embodiment, for example, the temperature of the display panel 100 at the location overlapping the driving board C-PBA depending on the sensing current SC may be calculated based on a temperature measurement value of the display panel 100 depending on the test driving current in the pre-driving process.

Accordingly, the first temperature weight WF1 may represent an effect of the printed circuit board S-PBA on the temperature of the display panel 100, the second temperature weight WF2 may represent an effect of the U-film U-FPC on the temperature of the display panel 100, the third temperature weight WF3 may represent an effect of the flexible cable FFC on the temperature of the display panel 100, and the fourth temperature weight WF4 may represent an effect of the driving board C-PBA on the temperature of the display panel 100.

Referring to FIGS. 1 and 5 to 8, an embodiment of the display panel driver 500 may apply the first temperature weight WF1 to a first panel block PB1 including a first overlap area OA1 overlapping the printed circuit boards S-PBA. The display panel driver 500 may apply the second temperature weight WF2 to a second panel block PB2 including a second overlap area OA2 overlapping the U-film U-FPC. The display panel driver 500 may apply the third temperature weight WF3 to a third panel block PB3 including a third overlap area OA3 overlapping the flexible cable FFC. The display panel driver 500 may apply the fourth temperature weight WF4 to a fourth panel block PB4 including a fourth overlap area OA4 overlapping the driving board C-PBA.

In an embodiment, for example, the printed circuit board S-PBA, the U-film U-FPC, the flexible cable FFC, and the driving board C-PBA may overlap the display panel 100 in a plan view in a thickness direction thereof. In an embodiment, for example, in the plan view, the first overlap area OA1, the second overlap area OA2, the third overlap area OA3, and the fourth overlap area OA4 may be defined by areas where the display panel 100 is covered by the printed circuit board S-PBA, the U-film U-FPC, the flexible cable FFC, and the driving board C-PBA, respectively. In an embodiment, for example, as shown in FIG. 6, the first panel block PB1 may be blocks 71, 72, 73, 74, 75, 76, 77, 78, 79, 7A, 7B, 7C, 81, 82, 83, 84, 85, 86, 87, 88, 89, 8A, 8B, and 8C, the second panel block PB2 may be blocks 73, 74, 79, and 7A, the third panel block PB3 may be blocks 55, 56, 57, 58, 65, 66, 67, 68, 75, 76, 77, and 78, and the fourth panel block PB4 may be blocks 35, 36, 37, 38, 45, 46, 47, 48, 55, 56, 57, and 58. In an embodiment, for example, as shown in FIG. 6, the first temperature weight WF1 may be applied to blocks 71, 72, 73, 74, 75, 76, 77, 78, 79, 7A, 7B, 7C, 81, 82, 83, 84, 85, 86, 87, 88, 89, 8A, 8B, and 8C, the second temperature weight WF2 may be applied to 73, 74, 79, and 7A, the third temperature weight WF3 may be applied to blocks 55, 56, 57, 58, 65, 66, 67, 68, 75, 76, 77, and 78, and the fourth temperature weight WF4 may be applied to blocks 35, 36, 37, 38, 45, 46, 47, 48, 55, 56, 57, and 58.

FIG. 9 is a table illustrating panel blocks PB of a display apparatus according to an embodiment.

The display apparatus of FIG. 9 is substantially the same as the display apparatus of FIG. 4 except for division of the panel blocks PB to which the respective temperature weights (WF1, WF2, WF3, and WF4; WF) are applied. Thus, the same reference numerals are used to refer to the same or similar element, and any repetitive detailed description thereof will be omitted.

Referring to FIGS. 6 and 9, an embodiment of the display panel driver 500 may apply the first temperature weight WF1 to the panel block PB in which the first overlap area OA1 is larger than the second overlap area OA2, the third overlap area OA3, and the fourth overlap area OA4. The display panel driver 500 may apply the second temperature weight WF2 to the panel block PB in which the second overlap area OA2 is larger than the first overlap area OA1, the third overlap area OA3, and the fourth overlap area OA4. The display panel driver may apply the third temperature weight WF3 to the panel block PB in which the third overlap area OA3 is larger than the first overlap area OA1, the second overlap area OA2, and the fourth overlap area OA4. The display panel driver 500 may apply the fourth temperature weight WF4 to the panel block PB in which the fourth overlap area OA4 is larger than the first overlap area OA1, the second overlap area OA2, and the third overlap area OA3.

In an embodiment, for example, as shown in FIG. 6, the panel blocks PB to which the first temperature weight WF1 is applied may be blocks 71, 72, 7A, 7B, 7C, 81, 82, 83, 84, 85, 86, 87, 88, 89, 8A, 8B, and 8C, the panel blocks PB to which the second temperature weight WF2 is applied may be blocks 73, 74, 79, and 7A, and the panel blocks PB to which the third temperature weight WF3 is applied may be blocks 65, 66, 67, 68, 75, 76, 77, and 78, and the panel blocks PB to which the fourth temperature weight WF4 is applied may be blocks 35, 36, 37, 38, 45, 46, 47, 48, 55, 56, 57, and 58.

Figure 10:
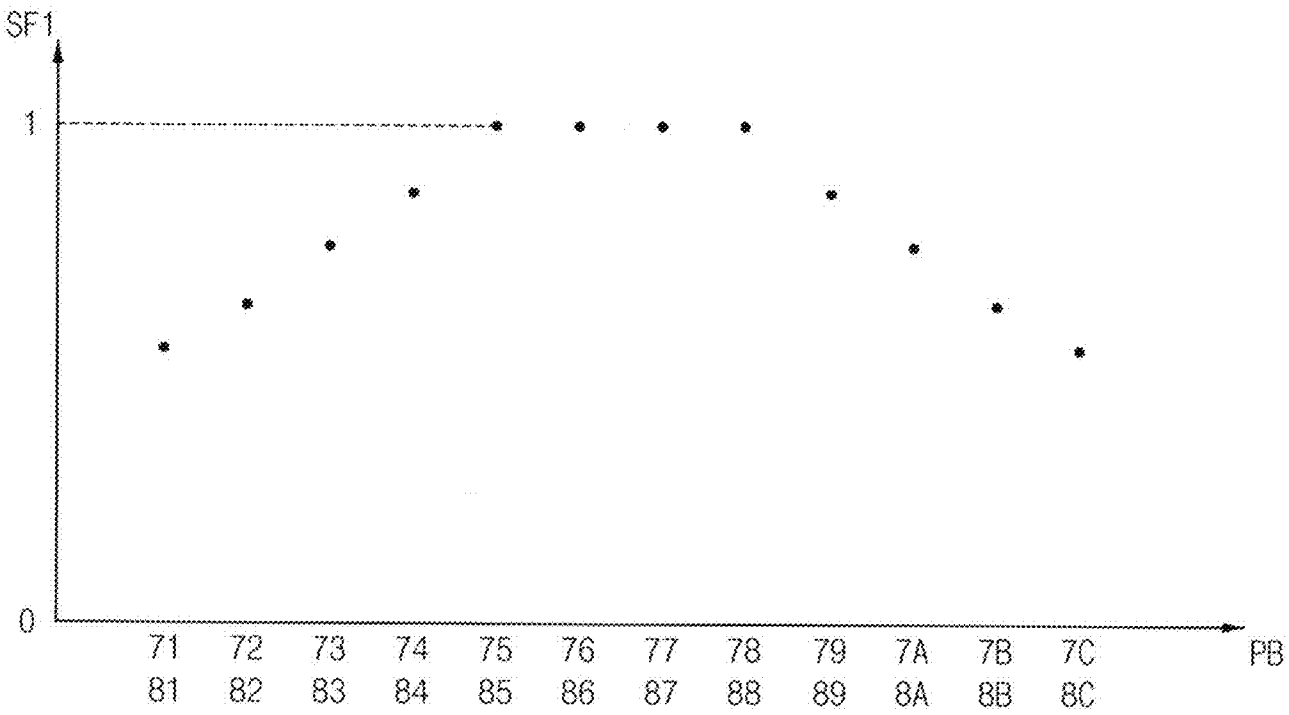
FIG. 10 is a graph illustrating a first scale factor applied to a panel block of a display apparatus according to an embodiment.

FIG. 10 is a graph illustrating a first scale factor SF1 applied to a panel block PB of a display apparatus according to an embodiment.

The display apparatus of FIG. 10 is substantially the same as the display apparatus of FIG. 4 except for applying the first scale factor SF1. Thus, the same reference numerals are used to refer to the same or similar element, and any repetitive detailed description thereof will be omitted.

Referring to FIGS. 5, 6, and 10, an embodiment of the display panel driver 500 may apply the first temperature weight WF1 and the first scale factor SF1 to the first panel block PB1. The display panel driver 500 may apply a product of the first temperature weight WF1 and the first scale factor SF1 to the first panel block PB1. The first scale factor SF1 may decrease as a distance between the first panel block PB1 and a connecting portion 700 increases. The printed circuit board S-PBA and the flexible cable FFC may be connected to each other at the connecting portion 700.

In an embodiment, for example, the first scale factor SF1 having a value of 1 may be applied to blocks 75, 76, 77, 78, 85, 86, 87, and 88 which are close to the connecting portion 700. In an embodiment, for example, as the distance of blocks in the first panel block PB1 from the connecting portion 700 increases (e.g., blocks 75 to 71, 78 to 7C, 85 to 81, or 88 to 8C), the first scale factor SF1 to be applied thereto may decrease. Since more current flows in portions of the printed circuit board S-PBA close to the connecting portion 700 than portions of the printed circuit board S-PBA far from the connecting portion 700, the first scale factor SF1 applied to the printed circuit board S-PBA far from the connecting portion 700 may be smaller than the first scale factor SF1 applied to the printed circuit board S-PBA close to the connecting portion 700. In such an embodiment, the display panel driver may more accurately calculate the predicted temperature BET of the panel block PB.

Figure 11:
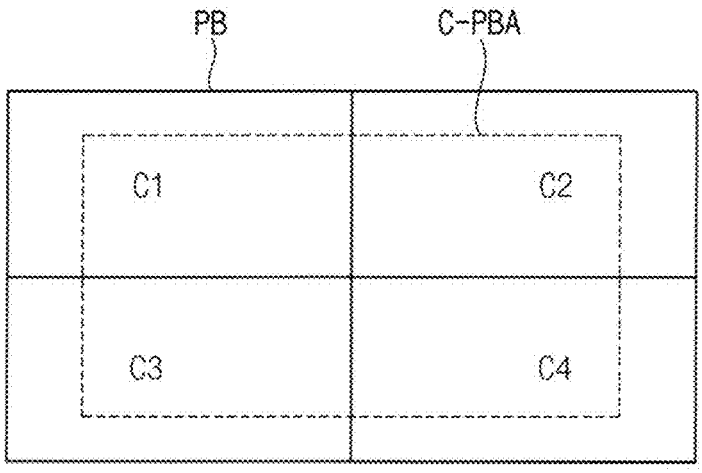
FIG. 11 is a diagram illustrating a fourth panel block of a display apparatus according to an embodiment.
Figure 12:
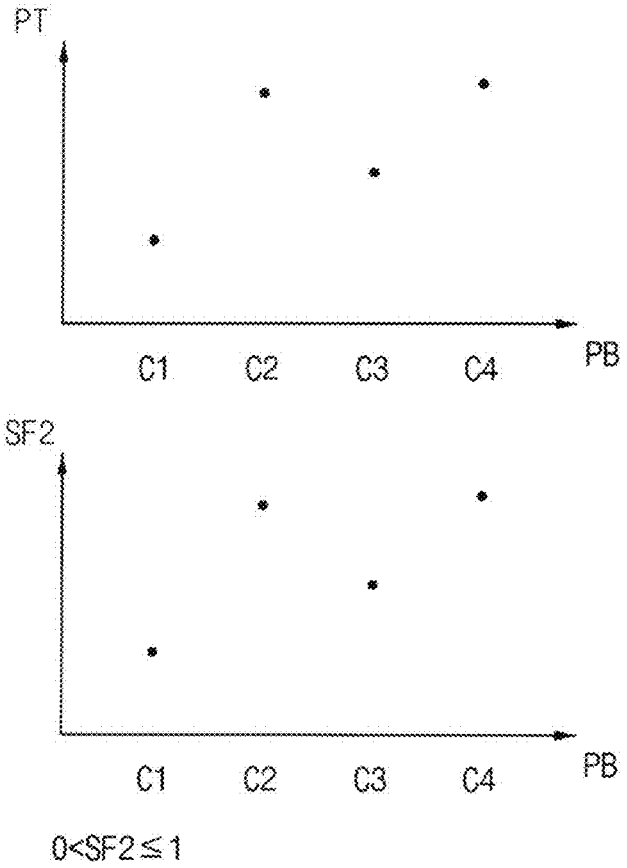
FIG. 12 is a graph illustrating a temperature of a panel block depending on a test driving current and a second scale factor applied to the panel block of the display apparatus of FIG. 11.
Figure 15:
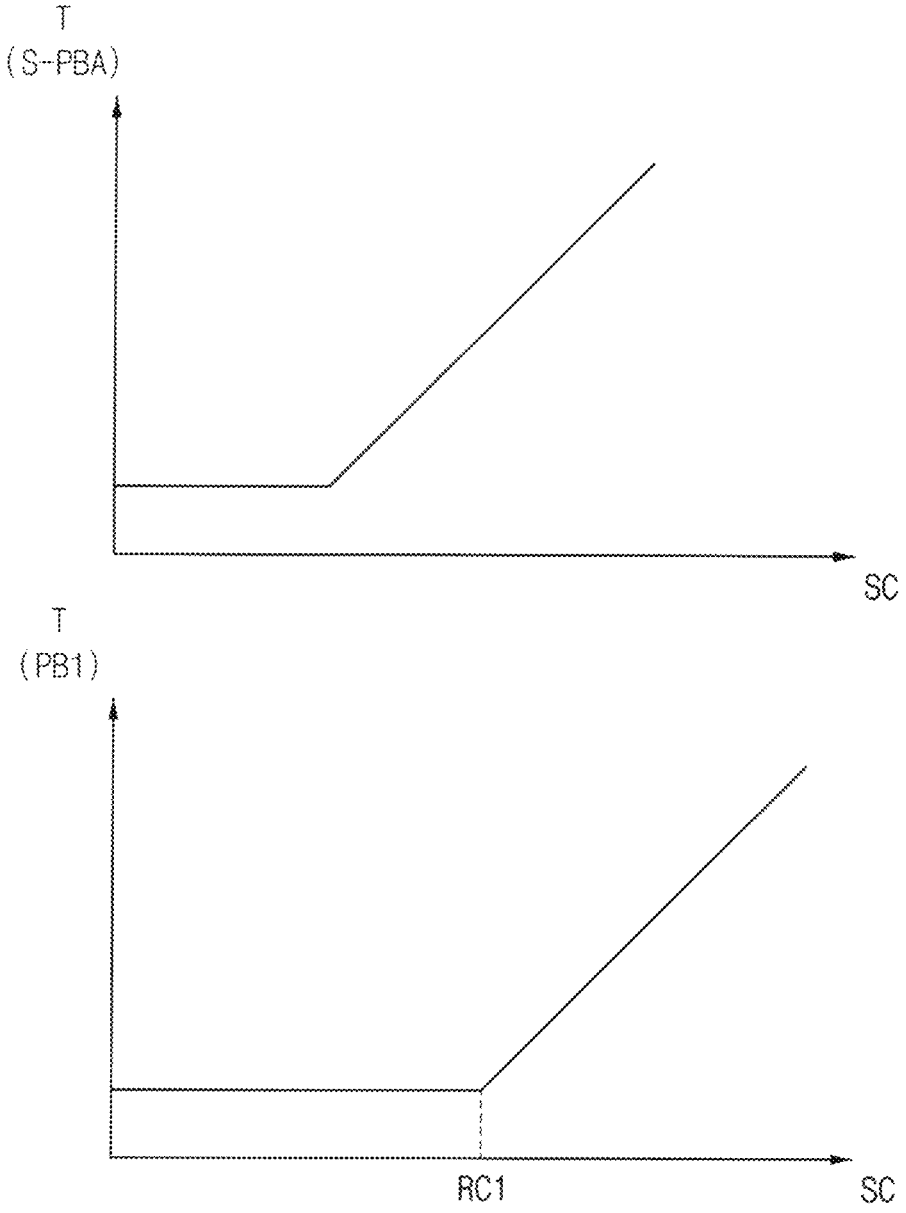
FIGS. 15 to 18 are graphs illustrating temperatures of circuit components depending on a sensing current and temperatures of panel blocks depending on the sensing current of the display apparatus of FIG. 4.
Figure 16:
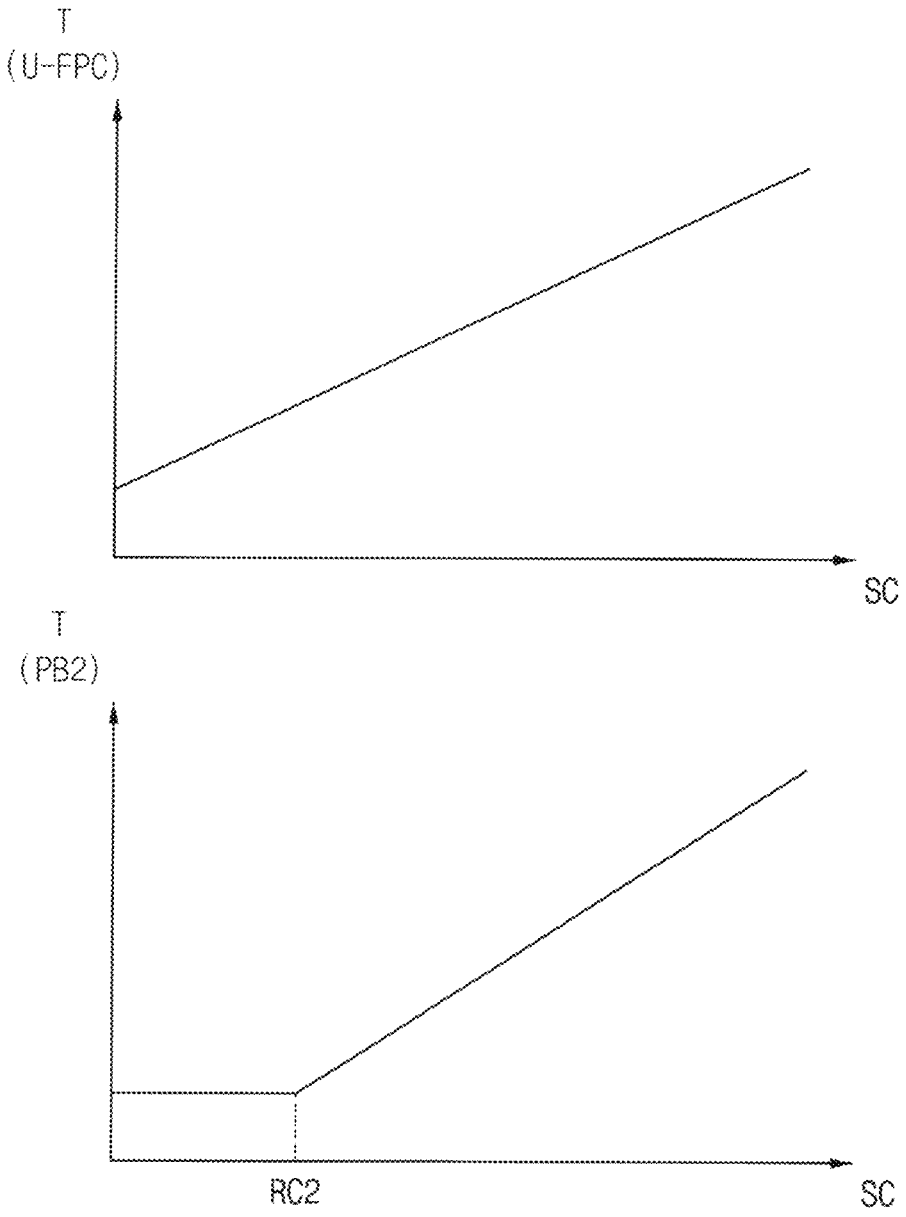
Figure 17:
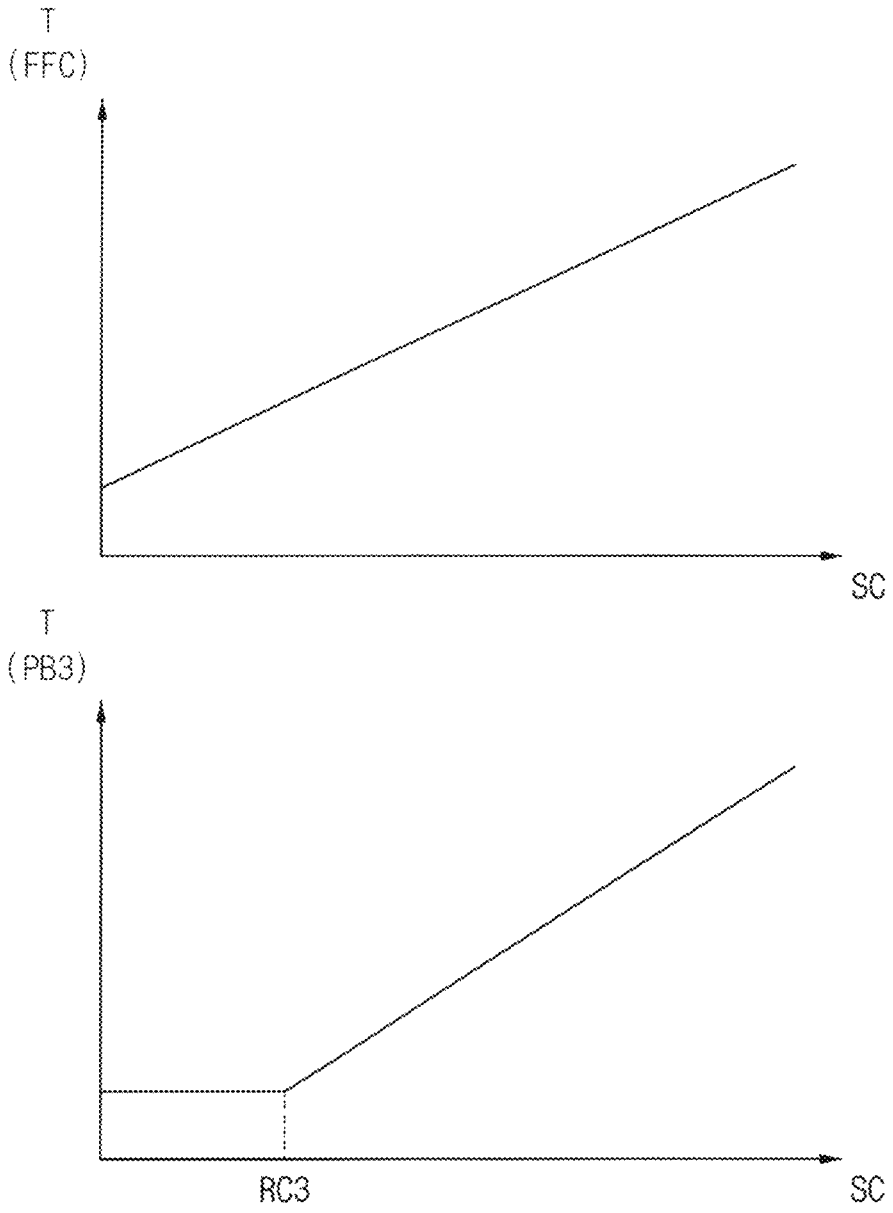
Figure 18:
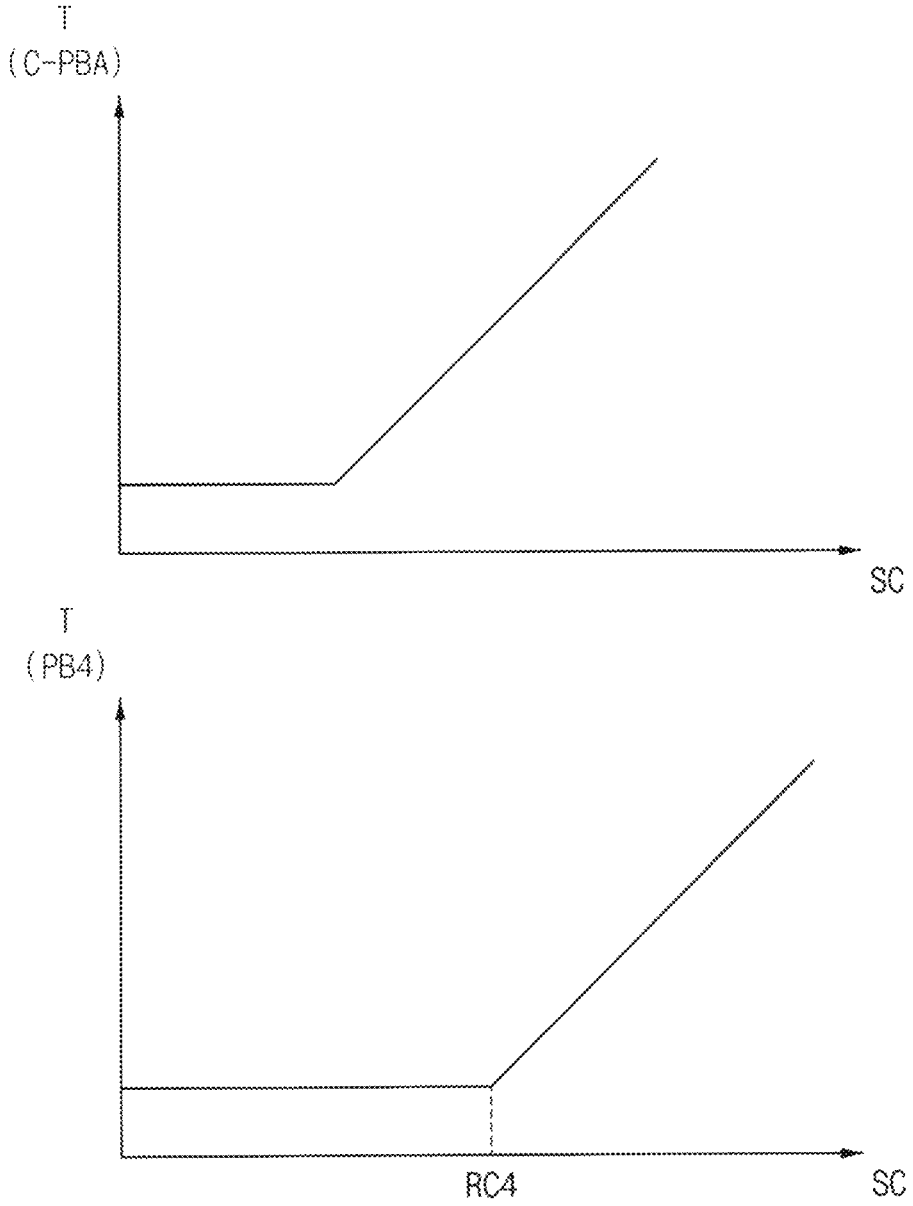

FIG. 11 is a diagram illustrating the fourth panel block PB4 of a display apparatus according to an embodiment. FIG. 12 is a graph illustrating a temperature PT of the panel block depending on a test driving current and a second scale factor SF2 applied to the panel block PB of the display apparatus of FIG. 11. The temperature PT of the panel block depending on the test driving current is a temperature considering only an influence of the temperature of the circuit components.

The display apparatus of FIGS. 11 and 12 is substantially the same as the display apparatus of FIG. 4 except for applying the second scale factor SF2, a location of the panel block PB, and numbers of the panel block PB. Thus, the same reference numerals are used to refer to the same or similar element, and any repetitive detailed description thereof will be omitted.

Referring to FIGS. 5, 6, 11, and 12, an embodiment of the display panel driver 500 may apply the fourth temperature weight WF4 and the second scale factor SF2 to the fourth panel block PB4. The second scale factor may be determined based on an arrangement of an internal circuit of the driving board C-PBA. The display panel driver 500 may apply a product of the fourth temperature weight WF4 and the second scale factor SF2 to the fourth panel block PB4.

In an embodiment, for example, referring to FIG. 12, each blocks of the fourth panel block PB4 (blocks C1, C2, C3, and C4) including the fourth overlap area OA of the same degree may have a different temperature PT of the panel block at the same test driving current. A temperature difference may occur in the driving board C-PBA depending on an arrangement of the internal circuit of the driving board C-PBA. In such an embodiment, the second scale factor SF2 may have a different value for each blocks of fourth panel block PB4 (blocks C1, C2,C3, and C4) to compensate for such a temperature difference. In an embodiment, for example, when the temperature PT of the panel block of the panel block C1 among the fourth panel blocks PB4 is the lowest at the same test driving current, a value of the second scale factor SF2 applied to the panel block C1 among the fourth panel blocks PB4 may be the smallest. The second scale factor SF2 may be greater than 0 and less than or equal to 1.

FIG. 13 is a table illustrating adjacent panel blocks of the display apparatus of FIG. 4. FIG. 14 is a table illustrating the panel block PB of the display apparatus of FIG. 4 to which the temperature weight WF and a third scale factor SF3 are applied.

Referring to FIGS. 5, 6, 13, and 14, the display panel driver 500 may apply the first temperature weight WF1 and the third scale factor SF3 to a first adjacent panel block PB1' adjacent to the first panel block PB1. The display panel driver 500 may apply the second temperature weight WF2 and the third scale factor SF3 to a second adjacent panel block PB2' adjacent to the second panel block PB2. The display panel driver 500 may apply the third temperature weight WF3 and the third scale factor SF3 to a third adjacent panel block PB3' adjacent to the third panel block PB3. The display panel driver 500 may apply the fourth temperature weight WF4 and the third scale factor SF3 to a fourth adjacent panel block PB4' adjacent to the fourth panel block PB. The third scale factor SF3 may be greater than 0 and less than 1.

In an embodiment, for example, referring to FIG. 5, the first panel block PB1 (blocks 71, 72, 73, 74, 75, 76, 77, 78, 79, 7A, 7B, 7C, 81, 82, 83, 84, 85, 86, 87, 88, 89, 8A, 8B, and 8C) may be adjacent to blocks 61, 62, 63, 64, 65, 66, 67, 68, 69, 6A, 6B, and 6C. Accordingly, the first adjacent panel block PB1' may be blocks 61, 62, 63, 64, 65, 66, 67, 68, 69, 6A, 6B, and 6C. In an embodiment, for example, the second panel block PB2 (blocks 73, 74, 79, and 7A) may be adjacent to blocks 62, 63, 64, 65, 68, 69, 6A, 6B, 72, 75, 78, 7B, 82, 83, 84, 85, 88, 89, 8A, and 8B. Accordingly, the second adjacent panel block PB2' may be blocks 62, 63, 64, 65, 68, 69, 6A, 6B, 72, 75, 78, 7B, 82, 83, 84, 85, 88, 89, 8A, and 8B. In an embodiment, for example, the third panel block PB3 (blocks 55, 56, 57, 58, 65, 66, 67, 68, 75, 76, 77, and 78 may be adjacent to blocks 44, 45, 46, 47, 48, 49, 54, 59, 64, 69, 74, 79, 84, 85, 86, 87, 88, and 89. Accordingly, the third adjacent panel block PB3' may be blocks 44, 45, 46, 47, 48, 49, 54, 59, 64, 69, 74, 79, 84, 85, 86, 87, 88, and 89. In an embodiment, for example, the fourth panel block PB4 (blocks 35, 36, 37, 38, 45, 46, 47, 48, 55, 56, 57, and 58) may be adjacent to blocks 24, 25, 26, 27, 28, 29, 34, 39, 44, 49, 54, 59, 64, 65, 66, 67, 68, and 69. Accordingly, the fourth adjacent panel block PB4' may be blocks 24, 25, 26, 27, 28, 29, 34, 39, 44, 49, 54, 59, 64, 65, 66, 67, 68, and 69. Accordingly, the first temperature weight WF1 and the third scale factor SF3 may be applied to blocks 61, 62, 63, 64, 65, 66, 67, 68, 69, 6A, 6B, and 6C, the second temperature weight WF2 and the third scale factor SF3 may be applied to the blocks 62, 63, 64, 65, 68, 69, 6A, 6B, 72, 75, 78, 7B, 82, 83, 84, 85, 88, 89, 8A, and 8B, the third temperature weight WF3 and the third scale factor SF3 may be applied to the blocks 44, 45, 46, 47, 48, 49, 54, 59, 64, 69, 74, 79, 84, 85, 86, 87, 88, and 89, and the fourth temperature weight WF4 and the third scale factor SF3 may be applied to the blocks 24, 25, 26, 27, 28, 29, 34, 39, 44, 49, 54, 59, 64, 65, 66, 67, 68, and 69. The effect of heat diffusion on the adjacent panel blocks PB1', PB2', PB3', and PB4' may be compensated by applying a product of the third scale factor SF3 less than 1 and the temperature factor WF to the adjacent panel blocks PB1', PB2', PB3', and PB4'.

FIGS. 15 to 18 are graphs illustrating the temperature of the circuit component depending on the sensing current SC and the temperature T(PB1), T(PB2), T(PB3), and T(PB4) of the panel blocks depending on the sensing current SC of the display apparatus of FIG. 4. The temperature T(PB1), T(PB2), T(PB3), and T(PB4) of the panel blocks is a temperature considering only the effect of the temperature of the circuit components. The temperature of the panel blocks depending on the temperature of the circuit component may be measured using the test driving current. As a result, the temperature T(PB1), T(PB2), T(PB3), and T(PB4) of the panel blocks depending on the sensing current SC may be represented in FIGS. 15 to 18. FIGS. 15 to 18 schematically show the temperature of the circuit component depending on the sensing current and the temperature of the panel blocks depending on the sensing current, and actually measured values may be different from those shown in the graphs of FIGS. 15 to 18.

Referring to FIGS. 15 to 18, an embodiment of the display panel driver 500 may apply the first temperature weight WF1 to the first panel block PB1 when the sensing current SC is greater than a first reference current RC1. The display panel driver 500 may apply the second temperature weight WF2 to the second panel block PB2 when the sensing current SC is greater than a second reference current RC2. The display panel driver 500 may apply the third temperature weight WF3 to the third panel block PB3 when the sensing current SC is greater than a third reference current RC3. The display panel driver 500 may apply the fourth temperature weight WF4 to the fourth panel block PB4 when the sensing current SC is greater than a fourth reference current RC4. Accordingly, the display panel driver 500 may not apply the first temperature weight WF1 to the first panel block PB1 when the sensing current SC is less than or equal to the first reference current RC1. The display panel driver 500 may not apply the second temperature weight WF2 to the second panel block PB2 when the sensing current SC is less than or equal to the second reference current RC2. The display panel driver 500 may not apply the third temperature weight WF3 to the third panel block PB3 when the sensing current SC is less than or equal to the third reference current RC3. The display panel driver 500 may not apply the fourth temperature weight WF4 to the fourth panel block PB4 when the sensing current SC is less than or equal to the fourth reference current RC4.

In an embodiment, for example, when the sensing current SC reaches a specific value or more, the temperature T(S-PBA) of the printed circuit board depending on the sensing current SC may increase. In such an embodiment, when the sensing current SC is equal to the first reference current RC1, the temperature T(PB1) of the first panel block may start to increase. In such an embodiment, when the sensing current SC is less than or equal to the first reference current RC1, the temperature T(S-PBA) of the printed circuit board may have little effect on the first panel block PB1, so that the display panel driver 500 may not apply the first temperature weight WF1 to the first panel block PB1.

In an embodiment, for example, when the sensing current SC reaches a specific value or more, the temperature T(U-FPC) of the U-film depending on the sensing current SC may increase. In such an embodiment, when the sensing current SC is equal to the second reference current RC2, the temperature T(PB2) of the second panel block may start to increase. In such an embodiment, when the sensing current SC is less than or equal to the second reference current RC2, the temperature T(U-FPC) of the U-film may have little effect on the second panel block PB2, so that the display panel driver 500 may not apply the second temperature weight WF2 to the second panel block PB2.

In an embodiment, for example, when the sensing current SC reaches a specific value or more, the temperature T(FFC) of the flexible cable depending on the sensing current SC may increase. In such an embodiment, when the sensing current SC is equal to the third reference current RC3, the temperature T(PB3) of the third panel block may start to increase.

In such an embodiment, when the sensing current SC is less than or equal to the third reference current RC3, the temperature T(FFC) of the flexible cable may have little effect on the third panel block PB3, so that the display panel driver 500 may not apply the third temperature weight WF3 to the third panel block PB3.

In an embodiment, for example, when the sensing current SC reaches a specific value or more, the temperature T(C-PBA) of the driving board depending on the sensing current SC may increase. In such an embodiment, when the sensing current SC is equal to the fourth reference current RC4, the temperature T(PB4) of the fourth panel block may start to increase. In such an embodiment, when the sensing current SC is less than or equal to the fourth reference current RC4, the temperature T(C-PBA) of the driving board may have little effect on the fourth panel block PB4, so that the display panel driver 500 may not apply the fourth temperature weight WF4 to the fourth panel block PB4.

Figure 19:
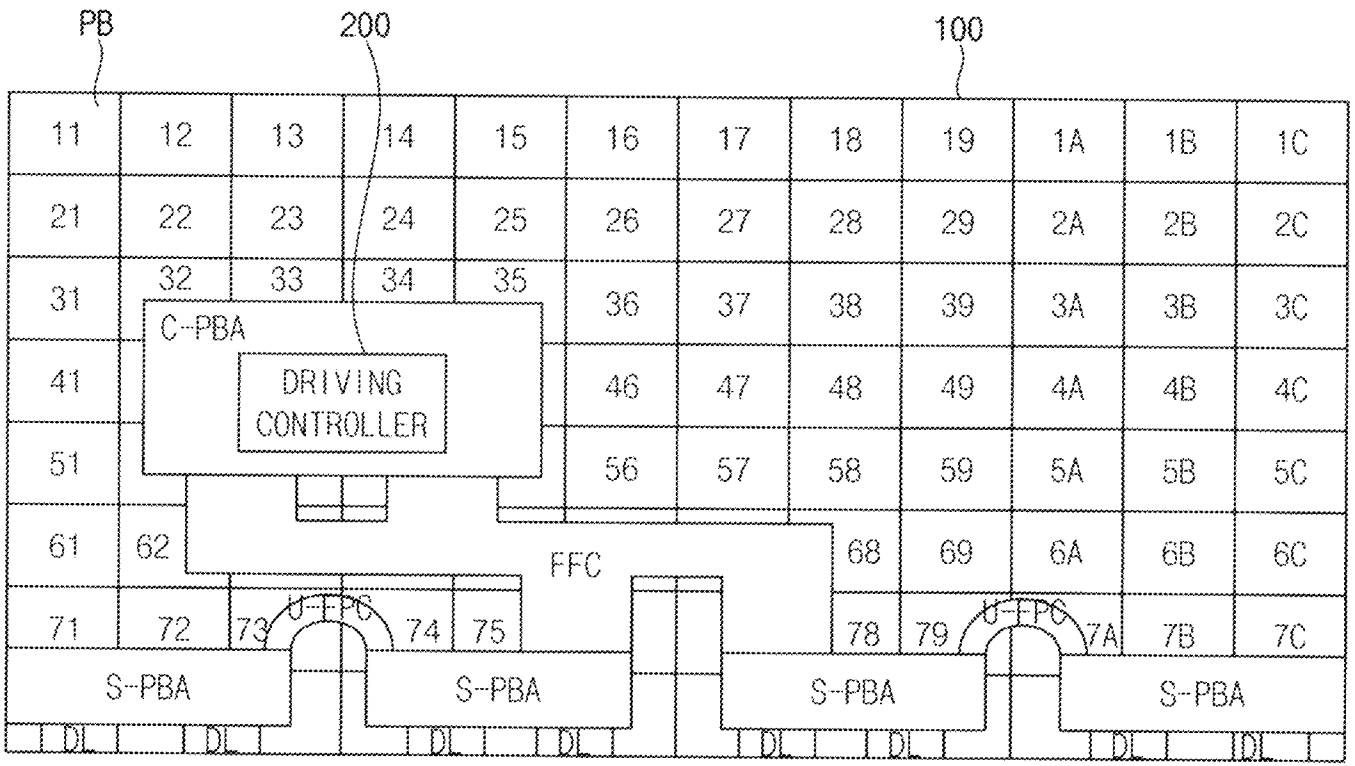
FIG. 19 is a block diagram illustrating a part of a display apparatus according to an embodiment.
Figure 20:
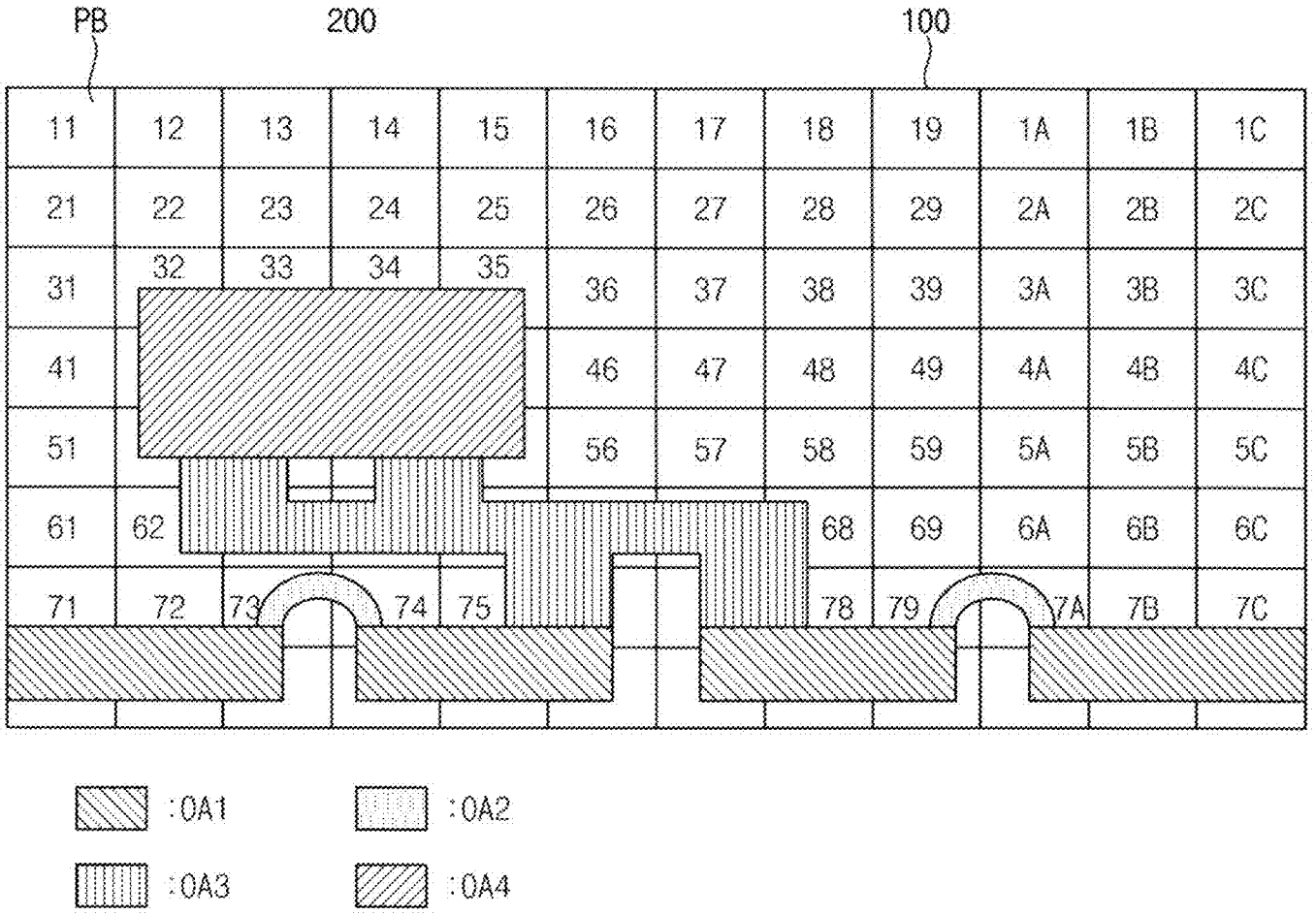
FIG. 20 is a diagram illustrating a display panel of the display apparatus of FIG. 19.

FIG. 19 is a block diagram illustrating a part of a display apparatus according to an embodiment. FIG. 20 is a diagram illustrating a display panel of the display apparatus of FIG. 19. FIG. 21 is a table illustrating panel blocks of the display apparatus of FIG. 19.

The display apparatus of FIGS. 19 to 21 is substantially the same as the display apparatus of FIG. 4 except for the location of the circuit component. Thus, the same reference numerals are used to refer to the same or similar element, and any repetitive detailed description thereof will be omitted.

Referring to 19 to 21, in an embodiment, the printed circuit board S-PBA, the U-film U-FPC, the flexible cable FFC, and the driving board C-PBA may overlap the display panel 100 in a plan view in a thickness direction thereof. In an embodiment, for example, in the plan view, the first overlap area OA1, the second overlap area OA2, the third overlap area OA3, and the fourth overlap area OA4 may be defined by areas where the display panel 100 is covered by the printed circuit board S-PBA, the U-film U-FPC, the flexible cable FFC, and the driving board C-PBA. In an embodiment, for example, as shown in FIGS. 5A and 20, the first panel block PB1 may be blocks 71, 72, 73, 74, 75, 76, 77, 78, 79, 7A, 7B, 7C, 81, 82, 83, 84, 85, 86, 87, 88, 89, 8A, 8B, and 8C, the second panel block PB2 may be 73, 74, 79, and 7A, the third panel block PB3 may be blocks 52, 53, 54, 62, 63, 64, 65, 66, 67, 68, 75, 76, 77, and 78, and the fourth panel block PB4 may be blocks 32, 33, 34, 35, 42, 43, 44, 45, 52, 53, 54, and 55.

Figure 22:
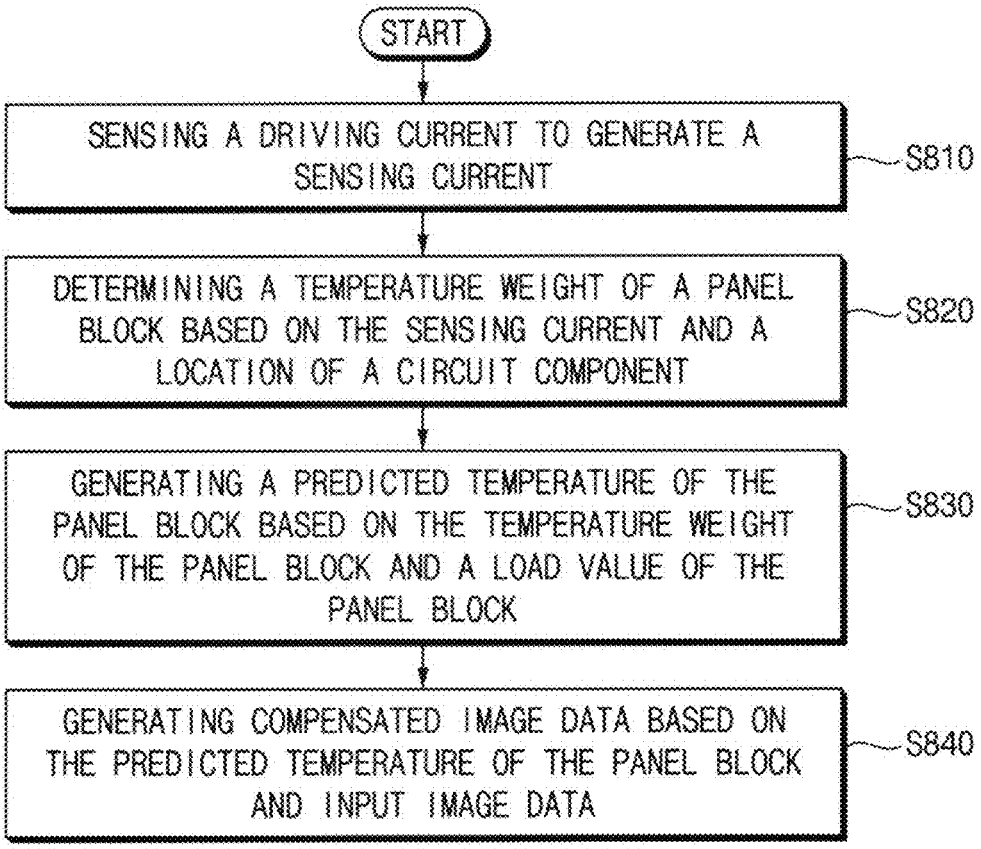
FIGS. 22 to 24 are flowcharts illustrating a method of driving a display apparatus according to an embodiment of the invention.
Figure 23:
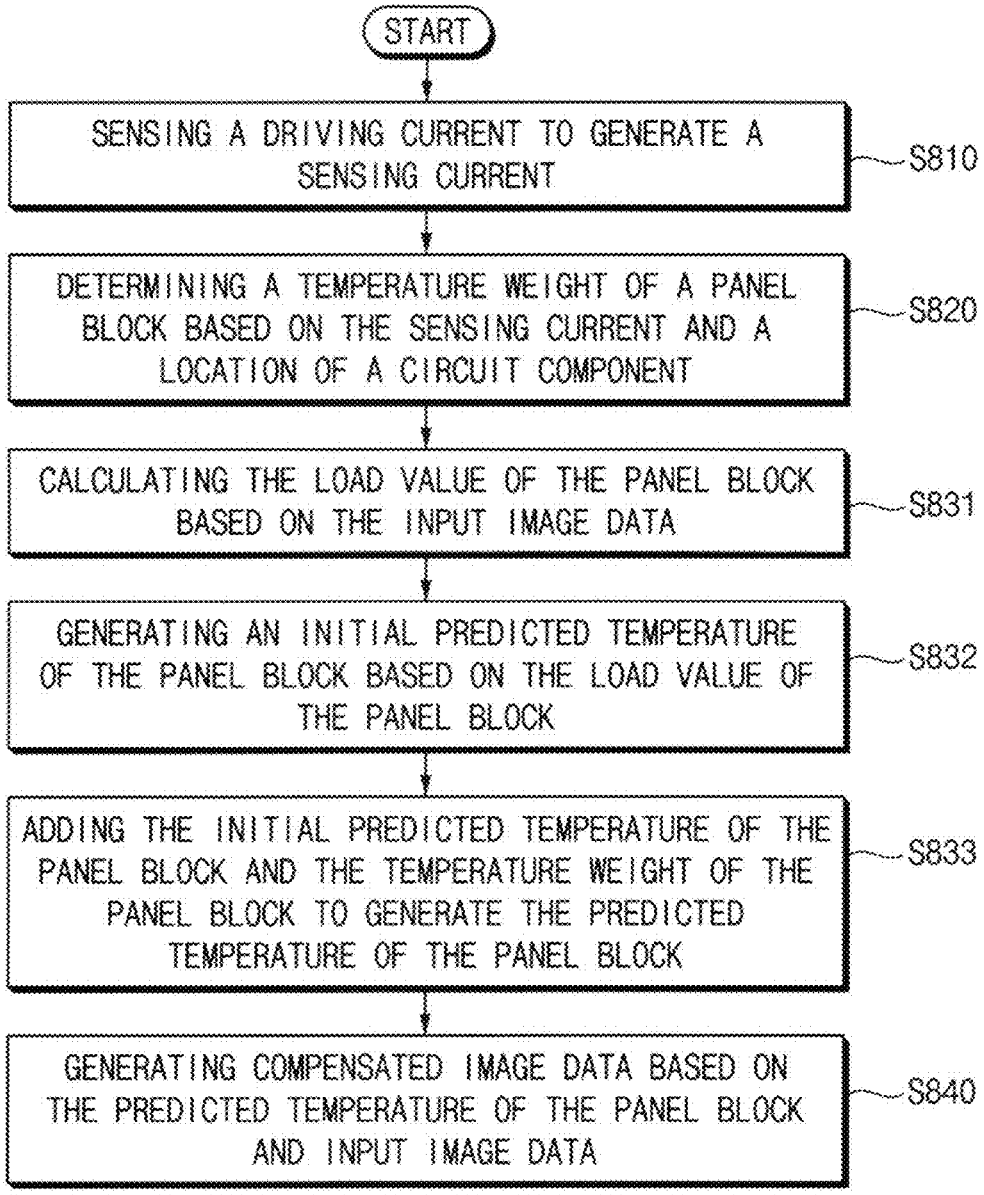
Figure 24:
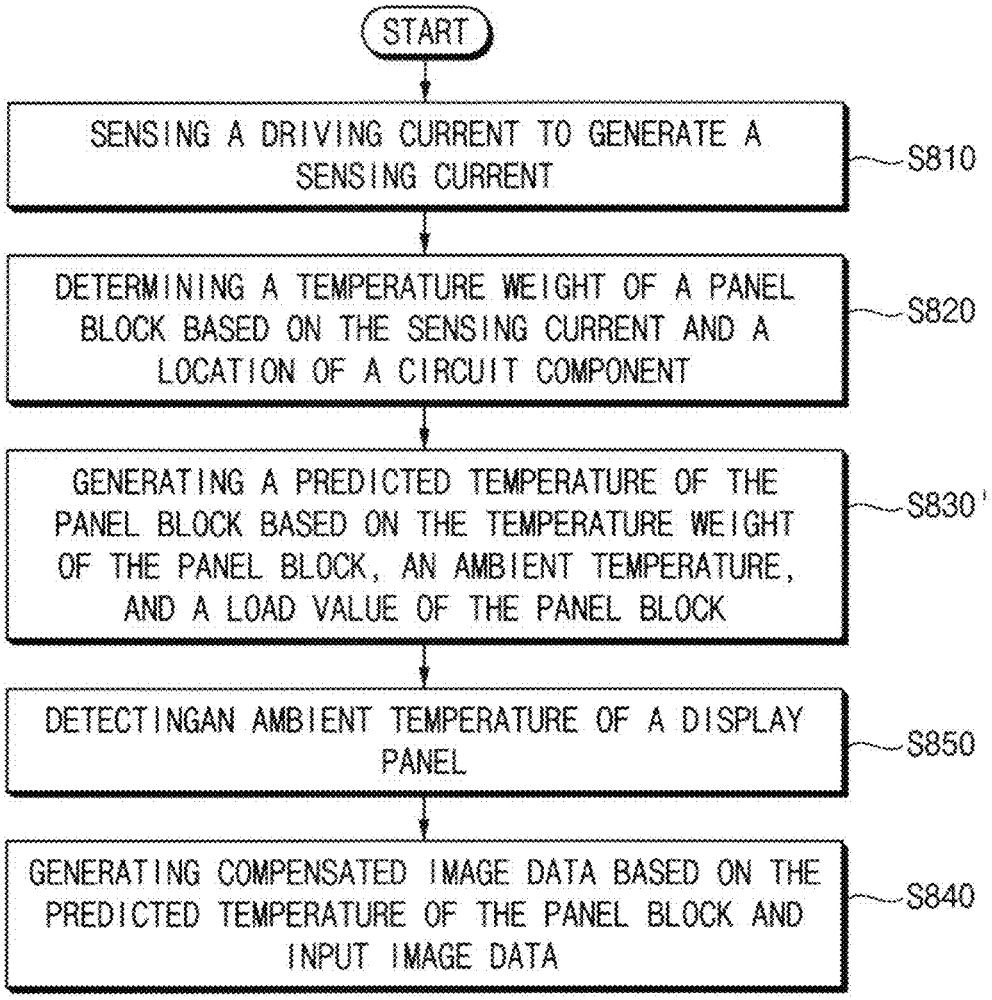

FIGS. 22 to 24 are flowcharts illustrating a method of driving a display apparatus according to an embodiment of the invention.

Referring to FIGS. 22 to 24, the method may sense the driving current to generate the sensing current SC (operation S810), determine the temperature weight WF of the panel block PB based on the sensing current SC and the location of the circuit component (operation S820), generate the predicted temperature BET of the panel block based on the temperature weight BWF of the panel block and the load value BL of the panel block (operation S830), and generate the compensated image data CIMG based on the predicted temperature BET of the panel block and the input image data IMG (operation S840).

According to an embodiment, the method may further detect the ambient temperature BT of the display panel. In such an embodiment, the predicted temperature BET of the panel block may be generated based on the temperature weight BWF of the panel block, the ambient temperature BT, and the load value BL of the panel block.

In an embodiment, the method may determine the temperature weight WF of the panel block PB based on the sensing current SC and the location of the circuit component (operation S820). The temperature weight BWF of the panel block may be determined based on the weight lookup table 211. The weight lookup table may store the temperature weight WF corresponding to the sensing current SC. The temperature weight WF corresponding to the sensing current SC may be determined based on a temperature measurement value of the display panel 100 depending on the test driving current.

According to an embodiment, the value of the temperature weight WF corresponding to the sensing current SC may be determined based on a temperature measurement value of the circuit component depending on the test driving current and the temperature measurement value of the display panel 100 depending on the temperature measurement value of the circuit component.

In an embodiment, for example, by measuring the temperature of the circuit component while changing the test driving current, the temperature of the circuit component depending on the sensing current SC may be measured. In such an embodiment, by measuring the temperature of the display panel 100 depending on the temperature of the circuit component, the temperature of the display panel 100 depending on the sensing current SC may be measured. As a result, the value of the temperature weight WF corresponding to the sensing current SC may be determined based on the measured results.

The temperature weight WF may include the first temperature weight WF1, the second temperature weight WF2, the third temperature weight WF3, and the fourth temperature weight WF4. The first temperature weight WF1 may be applied to the first panel block PB1 including the first overlap area OA1 overlapping the printed circuit board S-PBA. The second temperature weight WF2 may be applied to the second panel block PB2 including the second overlap area OA2 overlapping the U-film U-FPC. The third temperature weight WF3 may be applied to the third panel block PB3 including the third overlap area OA3 overlapping the flexible cable FFC. The fourth temperature WF4 weight may be applied to the fourth panel block PB4 including the fourth overlap area OA4 overlapping the driving board C-PBA.

In an embodiment, the method may generate the predicted temperature BET of the panel block based on the temperature weight BWF of the panel block and the load value BL of the panel block (operation S830). According to an embodiment, as shown in FIG. 23, the method may calculate the load value BL of the panel block based on the input image data IMG (operation S831), generate the initial predicted temperature of the panel block PB based on the load value BL of the panel block (operation S832), and add the initial predicted temperature of the panel block PB and the temperature weight BWF of the panel block to generate the predicted temperature BET of the panel block (operation S833).

Embodiments of the inventions may be applied any electronic apparatus including the display apparatus. In an embodiment, for example, the inventions may be applied to a television ("TV"), a digital TV, a three-dimensional ("3D") TV, a mobile phone, a smart phone, a tablet computer, a virtual reality ("VR") apparatus, a wearable electronic apparatus, a personal computer ("PC"), a home appliance, a laptop computer, a personal digital assistant (" "), a portable multimedia player ("PMP"), a digital camera, a music player, a portable game console, a navigation apparatus, etc.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display apparatus comprising:

a display panel including a panel block; and a display panel driver which senses a driving current to generate a sensing current, generates a temperature weight of the panel block based on the sensing current and location information of a circuit component, generates a load value of the panel block based on input image data, and generates a predicted temperature of the panel block based on the temperature weight of the panel block and the load value of the panel block.

2. The display apparatus of claim 1, further comprising:

a temperature sensor which detects an ambient temperature of the display panel, wherein the display panel driver generates the predicted temperature of the panel block based on the ambient temperature, the temperature weight of the panel block, and the load value of the panel block.

3. The display apparatus of claim 1, wherein the display panel driver includes a weight lookup table which stores the temperature weight corresponding to the sensing current, and wherein the temperature weight corresponding to the sensing current is determined based on a temperature of the circuit component depending on the sensing current and a temperature of the display panel at a location overlapping the circuit component depending on the temperature of the circuit component.

4. The display apparatus of claim 1, wherein the display panel driver includes:

a plurality of printed circuit boards electrically connected to the display panel;

a U-film connecting the printed circuit boards to each other;

a flexible cable connected to the printed circuit board; and a driving board connected to the flexible cable, wherein the driving board generates a signal for driving the display panel, wherein the location information of the circuit component includes location information of the printed circuit boards, the U-film, the flexible cable, and the driving board.

5. The display apparatus of claim 4, wherein the temperature weight includes a first temperature weight, a second temperature weight, a third temperature weight, and a fourth temperature weight, wherein the display panel driver includes:

a first lookup table which stores the first temperature weight corresponding to the sensing current;

a second lookup table which stores the second temperature weight corresponding to the sensing current;

a third lookup table which stores the third temperature weight corresponding to the sensing current; and a fourth lookup table which stores the fourth temperature weight corresponding to the sensing current.

6. The display apparatus of claim 5, wherein the first temperature weight corresponding to the sensing current is determined based on a temperature of the printed circuit board depending on the sensing current and a temperature of the display panel at a location overlapping the printed circuit board depending on the temperature of the printed circuit board, wherein the second temperature weight corresponding to the sensing current is determined based on a temperature of the U-film depending on the sensing current and a temperature of the display panel at a location overlapping the U-film depending on the temperature of the U-film, wherein the third temperature weight corresponding to the sensing current is determined based on a temperature of the flexible cable depending on the sensing current and a temperature of the display panel at a location overlapping the flexible cable depending on the temperature of the flexible cable, and wherein the fourth temperature weight corresponding to the sensing current is determined based on the temperature of the driving board depending on the sensing current and a temperature of the display panel at a location overlapping the driving board depending on the temperature of the driving board.

7. The display apparatus of claim 5, wherein the display panel driver applies the first temperature weight to the panel block in a case where a first overlap area thereof overlapping the printed circuit board is larger than a second overlap area thereof overlapping the U-film, a third overlap area thereof overlapping the flexible cable, and a fourth overlap area thereof overlapping the driving board, wherein the display panel driver applies the second temperature weight to the panel block in a case where the second overlap area is larger than the first overlap area, the third overlap area, and the fourth overlap area, wherein the display panel driver applies the third temperature weight to the panel block in a case where the third overlap area is larger than the first overlap area, the second overlap area, and the fourth overlap area, and wherein the display panel driver applies the fourth temperature weight to the panel block in a case where the fourth overlap area is larger than the first overlap area, the second overlap area, and the third overlap area.

8. The display apparatus of claim 5, wherein the display panel driver is applies the first temperature weight to a first panel block including a first overlap area overlapping the printed circuit boards, wherein the display panel driver applies the second temperature weight to a second panel block including a second overlap area overlapping the U-film, wherein the display panel driver applies the third temperature weight to a third panel block including a third overlap area overlapping the flexible cable, and wherein the display panel driver applies the fourth temperature weight to a fourth panel block including a fourth overlap area overlapping the driving board.

9. The display apparatus of claim 8, wherein the display panel driver applies the first temperature weight and a first scale factor to the first panel block, and wherein the first scale factor decreases as a distance between the first panel block and a connecting portion, where the printed circuit board and the flexible cable are connected, increases.

10. The display apparatus of claim 8, wherein the display panel driver applies the fourth temperature weight and a second scale factor to the fourth panel block, and wherein the second scale factor is determined based on an arrangement of an internal circuit of the driving board.

11. The display apparatus of claim 8, wherein the display panel driver applies the first temperature weight and a third scale factor to a first adjacent panel block adjacent to the first panel block, wherein the display panel driver applies the second temperature weight and the third scale factor to a second adjacent panel block adjacent to the second panel block, wherein the display panel driver applies the third temperature weight and the third scale factor to a third adjacent panel block adjacent to the third panel block, and wherein the display panel driver applies the fourth temperature weight and the third scale factor to a fourth adjacent panel block adjacent to the fourth panel block.

12. The display apparatus of claim 11, wherein the third scale factor is greater than 0 and less than 1.

13. The display apparatus of claim 8, wherein the display panel driver applies the first temperature weight to the first panel block when the sensing current is greater than a first reference current, wherein the display panel driver applies the second temperature weight to the second panel block when the sensing current is greater than a second reference current, wherein the display panel driver applies the third temperature weight to the third panel block when the sensing current is greater than a third reference current, and wherein the display panel driver applies the fourth temperature weight to the fourth panel block when the sensing current is greater than a fourth reference current.

14. A method of driving a display apparatus, the method comprising:

sensing a driving current to generate a sensing current;

determining a temperature weight of a panel block of a display panel of the display apparatus based on the sensing current and a location of a circuit component;

generating a predicted temperature of the panel block based on the temperature weight of the panel block and a load value of the panel block; and generating compensated image data based on the predicted temperature of the panel block and input image data.

15. The method of claim 14, wherein the generating the predicted temperature includes:

calculating the load value of the panel block based on the input image data;

generating an initial predicted temperature of the panel block based on the load value of the panel block; and adding the initial predicted temperature of the panel block and the temperature weight of the panel block to generate the predicted temperature of the panel block.

16. The method of claim 14, further comprising:

detecting an ambient temperature of the display panel, wherein the predicted temperature of the panel block is generated based on the temperature weight of the panel block, the ambient temperature, and the load value of the panel block.

17. The method of claim 14, wherein the temperature weight of the panel block is determined based on a weight lookup table, wherein the weight lookup table stores the temperature weight corresponding to the sensing current, and wherein the temperature weight corresponding to the sensing current is determined based on a temperature measurement value of the display panel depending on a test driving current.

18. The display method of claim 14, wherein the temperature weight of the panel block is determined based on a weight lookup table, wherein the weight lookup table stores the temperature weight corresponding to the sensing current, and wherein the temperature weight corresponding to the sensing current is determined based on a temperature measurement value of the circuit component depending on a test driving current and a temperature measurement value of the display panel depending on the temperature measurement value of the circuit component.

19. The method of claim 14, wherein the temperature weight includes a first temperature weight, a second temperature weight, a third temperature weight, and a fourth temperature weight, wherein the first temperature weight is applied to a first panel block including a first overlap area overlapping a printed circuit board of the circuit component, wherein the second temperature weight is applied to a second panel block including a second overlap area overlapping a U-film of the circuit component, wherein the third temperature weight is applied to a third panel block including a third overlap area overlapping a flexible cable of the circuit component, and wherein the fourth temperature weight is applied to a fourth panel block including a fourth overlap area overlapping a driving board of the circuit component.

* * * * *